US006145705A

United States Patent [19]

Wallace et al.

[11] Patent Number: 6,145,705

[45] Date of Patent: Nov. 14, 2000

[54] DRY CONDIMENT DISPENSING SYSTEM

[75] Inventors: Mary Wallace; Amy Latz Burba, both of Vandenberg AFB; Peter Mueller, Los Gatos, all of Calif.

[73] Assignee: Mary M. Wallace, San Diego, Calif.

[21] Appl. No.: 09/112,859

[22] Filed: Jul. 9, 1998

[51] Int. Cl.[7] ..... B67D 5/64

[52] U.S. Cl. ..... 222/162; 222/160; 222/164; 222/166; 222/167; 222/185.1; 222/559; 222/560; 222/561

[58] Field of Search ..... 222/160, 162, 222/164, 166, 167, 185.1, 559, 560, 561

[56] References Cited

U.S. PATENT DOCUMENTS

| | | | |
|---|---|---|---|
| 2,340,681 | 2/1944 | Oursler | 222/164 |
| 2,358,913 | 9/1944 | Dobkin | 222/162 |
| 2,681,169 | 6/1954 | Watson | 222/162 |
| 3,744,677 | 7/1973 | Beall | 222/162 |
| 4,102,477 | 7/1978 | Yoon | 222/438 |

*Primary Examiner*—Steven O. Douglas
*Assistant Examiner*—Timothy L. Maust
*Attorney, Agent, or Firm*—Michael A. Glenn; Donald M. Hendricks

[57] ABSTRACT

A dry condiment dispensing system is provided, in which the contents of the dispenser are dispensed through one or more dispensing holes at the bottom of a storage container. A stationary shutter is placed over the dispensing holes to prevent undesired dispensing of the contents of the dispenser. When the storage container is moved in relation to the stationary shutter, the dispensing holes are aligned over a spout in the shutter, such that the stored contents may be dispensed through the dispensing holes and the spout. In a preferred embodiment, the storage container is moved along an axis between a closed position and a dispensing position by a cam. In another preferred embodiment, the storage container is spring loaded, such that the storage container returns to a normally closed position. One or more condiment dispensers can be used to organize such condiments as nutmeg, cinnamon, sugar, and cocoa powder at a coffee station, such as at a gourmet coffee shop.

66 Claims, 14 Drawing Sheets

DRY CONDIMENT DISPENSING SYSTEM

FIELD OF THE INVENTION

The invention relates to the field of condiment dispensers. More particularly, the invention relates to a dry condiment dispenser for particulate solid materials.

BACKGROUND OF THE INVENTION

Condiment dispensers are used for a variety of applications. Dry condiment dispensers typically include a storage container having one or more chambers, and one or more selectable dispensing orifices. Use of the dispenser typically requires the user to align one of the dispensing orifices with an opening in the top of storage container, direct the dispenser over the intended dispensing location, and rotate the dispenser to allow the condiment to be dispensed.

S. Stillinger, Dispensing Devices, U.S. Pat. No. 4,380,307 (Apr. 19, 1983) discloses a "closure device for a container provided with at least three compartments open at the top of the container and angularly offset from one another around the container axis, including a cover mounted on the top of the container, and presenting first and second dispensing openings, a cap covering the top of the container, enclosing the cover and provided with an outlet opening, and linkage connected between the cover and cap for permitting the cap to rotate relative to the cover so that the outlet opening of the cap moves between the first and second dispensing openings". While Stillinger discloses a device that can be used to dispense different condiments, and provides different dispensing openings for dispensing varying amounts of condiments, the handheld device requires the manual action of a user to choose the desired dispenser opening, align the dispenser opening and outlet opening with the desired condiment, and manually dispense the condiment. Furthermore, condiments must either be filled manually into each of the compartments of the chamber, or new containers full of new condiments must be replaced as a unit, potentially resulting in the waste of remaining condiments in other compartments within the old container.

L. Zimmerman, Condiment Shaker, U.S. Pat. No. 5,192,005 (Mar. 9, 1993) discloses a "condiment shaker including a hollow body with an enlarged opening therethrough receiving a pivotally mounted lid for rocking between a closed position and a dispensing position". While Zimmerman discloses a shaker that can be used to dispense different condiments, the shaker requires the manual action of a user to align the dispenser opening and to manually dispense the condiment. Furthermore, condiments must be filled manually into the shaker.

J. Swett and E. Herlow, Condiment Shaker, U.S. Pat. No. 4,488,667 (Dec. 18, 1984) disclose a container for condiments having multiple distinct dispensing ports. A mountable cover includes a movable component, which, upon displacement, exposes one of the dispensing ports. The cover is mountable at predetermined positions for alignment of the movable component with any one of the discharge ports for a selective exposure thereof while the remaining ports remain sealed. While Swett et al. disclose the selective application of different ports for the dispensing of a condiment in a manual hand-shaker, the user must manually pick up, rotate and shake the dispenser to dispense the condiments.

W. Bounds, Dual Condiment Dispenser, U.S. Pat. No. 4,193,521 (Mar. 18, 1980) discloses a "condiment dispenser having two separate compartments for use in separately dispensing two different condiments, such as salt and pepper. The top of the compartment is covered by a cap member. One or more apertures are formed in opposite sides of the cap member to form a condiment pouting outlet for each of the compartments". While Bounds discloses a device that can be used to dispense different condiments, and provides different dispensing openings for dispensing varying amounts of condiments, the handheld device requires the manual action of a user to manually dispense the condiment. Furthermore, condiments must either be filled manually into each of the compartments of the chamber, or new containers full of new condiments must be replaced as a unit, potentially causing waste of remaining condiments in other compartments within the old container.

Sellers, Condiment Shaker, U.S. Pat. No. 5,429,281 (Jul. 4, 1995) discloses a condiment shaker having a structure which provides for the condiment "to be discharged by shaking up and down but without reversing the shaker from its storage position, the condiment remaining is effectively isolated from the atmosphere". While Sellers discloses a shaker that can be used to dispense different condiments, the shaker requires the manual action of a user to manually dispense the condiment. Furthermore, condiments must be filled manually into the shaker.

H. Spies, Dispensing Apparatus, U.S. Pat. No. 4,026,336 (May 31, 1977) discloses the transfer of materials from a first container to a second container. Loose materials are transferrable from the first container via a neck or spout assembly, which is adapted for use in transferring the materials into the second container, in which the second container includes a normally closed access opening in a lid or endwall dimensioned to permit passage of a tubular member of the neck assembly. While Spies discloses the downward dispensing of materials through an opening, the disclosed second container is highly specialized, and requires direct contact with the first container to initiate dispensing therebetween.

M. Austin, Dispenser for Flowable Particulate Material, U.S. Pat. No. 3,927,807 (Dec. 23, 1975) discloses a "device for use with a container for flowable material for dispensing predetermined volumes of the material from the container, the dispenser including an outer element fixed with respect to the container and an inner element slidable with respect to the outer element between an open position and a closed position". "The outer element is provided with a door to discharge the contents of each compartment, and the inner element is provided with an operating handle extending through the wall of the container so that operating the handle causes the inner element to slide between its open and closed position". While Austin discloses a dispenser that can be used to dispense different volumes of condiments, the shaker requires the manual action of a user to manually dispense the condiment. Furthermore, the dispensed volume of condiment must be refilled each time the dispenser is used.

R. Russillo, and D. Russillo, Dispenser Apparatus, U.S. Pat. No. 5,437,396 (Aug. 1, 1995) disclose dispensers which dispense condiments from a chamber, in which "a push-valve extends the inside of the chamber through the bottom of the chamber. The valve has an up position which fills and stores a preselected amount of the condiment, and a down position which dispenses the condiment. The valve has an inner cylinder which slides within an outer cylinder". While Russillo et al. disclose a dispenser in which a specific volume of condiment is dispensed, the condiment is transferred on a "store and forward" basis, requiring the repeated operations of the dispenser to dispense different quantities. Furthermore, the device is not easily adapted to dispense different specific volumes. Also, the condiments are added directly to top chamber, which includes numerous components that come into direct contact with the condiments.

Other prior art manual hand-held dispensers have addressed the clearing of dispensing passages for dry condiments.

W. Morris, Container and Dispenser for Material in Granular or Powder Form, U.S. Pat. No. 4,598,844 (Jul. 8, 1986) discloses a "container and dispenser for granular or powdered material in which the container has an upper aperture and dispensing orifices are defined by a flexible member which permits the orifices to be expanded with resulting contraction to break loose clogged material from the orifices". While Morris discloses that the container and dispenser include a flexible member to break loose clogged material, the flexible member is located directly in the opening of the dispenser, potentially restricting flow of condiment, and requiring movement of the flexible member to initiate the breaking loose of clogged material.

P. Patrinos, Condiment Dispenser with Hole-Clearing Means, U.S. Pat. No. 4,214,678 (Jul. 29, 1980) discloses a "condiment dispenser including a container having a plurality of dispensing openings in the top surface thereof; a plurality of prongs disposed within the container aligned for insertion into the openings", a camming bar, and a spring for biasing the prongs away from the openings and against the camming bar.

R. Jordan and R. Boldt, Dispensing Grid, U.S. Pat. No. 3,563,417 (Feb. 16, 1971) disclose a "dispensing grid for use in a dispenser for solid, particulate matter, such as salt, features rounded upper surfaces and wedge-shaped lower surfaces, the intersecting ribs comprising the grid preferably being at two levels". "The rounded upper surfaces minimize salt-entrapment beneath the flush-fitting closure, and the chisel-point lower surfaces break up agglomerated lumps of the material".

Some prior art has addressed the use of multiple dispensers and condiment storage systems.

R. Gettleman and P. Stoner, Mobile Beverage Dispensing Cart, U.S. Pat. No. 4,076,349 (Feb. 28, 1978) disclose a "mobile, self-contained beverage dispensing cart", "containing a plurality of internal and external non-communicating chambers for the storage of hot liquid beverages, and the liquid and gaseous components of the cold dispensed beverages to be dispensed therefrom". "The hot beverages are dispensed by gravity feed through manually-controlled spigots, whereas the cold carbonated beverages are dispensed with the aid of pressure generated within the system by $CO_2$ stored in tanks incorporated within the cart's interior". While Gettleman et al. disclose the use of multiple beverage dispensers, they fail to disclose specific dispensing hardware for dry condiments.

D. Medellin and R. Pope, Refreshment Center for Use with Bottled Water Dispensers, U.S. Pat. No. 4,895,418 (Jan. 23, 1990) disclose a "portable refreshment center particularly adapted to fit over a conventional water bottle of a water bottle dispenser comprising a compartmentalized refreshment item retaining means for orderly storage of various individual condiment and refreshment items, and a mounting means for mounting it on the water bottle". While Medellin et al. disclose the compartmentalized storage of various individual condiment and refreshment items, they fail to disclose specific dispensing hardware for dry condiments.

D. Boyd, Securable Beverage Dispensing Server, U.S. Pat. No. 4,811,872 (Mar. 14, 1989) discloses a beverage and condiment dispensing server, which "consists of a support framework having a base, a cup supporting service and sidewalls extending generally vertically therebetween". The server's base is "dimensioned to receive two, laterally positioned, removable trays for receiving and organizing condiments and the like". While Boyd discloses the compartmentalized storage of various individual condiments, he fails to disclose specific dispensing hardware for dry condiments.

Several designs have also been disclosed for single and multiple condiment dispensers.

Ancona and J. Ancona, Condiment Dispenser, U.S. Pat. No. 338,598 (Aug. 24, 1993) disclose a design for a hand-held grinding dispenser.

W. Bounds, Condiment Dispenser, U.S. Pat. No. 257,205 (Oct. 7, 1980) discloses a design for a hand-held multiple condiment dispenser.

Ancona and J. Ancona, Condiment Dispenser, U.S. Pat. No. 336,831 (Jun. 29, 1993) disclose a design for a hand-held grinding dispenser.

T. Bovet, Condiment Dispenser, U.S. Pat. No. 262,768 (Jan. 26, 1982) discloses a design for a condiment dispenser having a closed position and an open position.

Reeves-Jackson, Condiment Dispenser, U.S. Pat. No. 336,016 (Jun. 1, 1993) discloses a design for a condiment dispenser having multiple compartments and multiple dispensing openings.

B. Ancona and J. Ancona, Condiment Dispenser, U.S. Pat. No. 336,833 (Jun. 29, 1993) disclose a design for a hand-held dispenser.

W. Morris, Combined Condiment Dispenser and Stand Therefor, U.S. Pat. No. 352,867 (Nov. 29, 1994) discloses a design for a combined dispenser.

The disclosed prior art systems and methodologies thus provide condiment shakers and dispensers, but fail to provide a condiment dispensing system that allows the precise controlled delivery of varying quantities of different condiments, in a design that does not require the user to manually lift, rotate or shake the storage container. The development of such a condiment dispensing system would constitute a major technological advance. Furthermore, the development of multiple condiment dispensing systems that can be combined to form a dispensing station would constitute a major technological advance.

SUMMARY OF THE INVENTION

A dry condiment dispensing system is provided, in the contents of the dispenser are dispensed through an one or more dispensing holes at the bottom of a storage container. A stationary shutter is placed over the dispensing holes to prevent undesired dispensing of the contents of the dispenser. When the storage container is moved in relation to the stationary shutter, the dispensing holes are aligned over a spout in the shutter, such that the stored contents may be dispensed through the dispensing holes and the spout. In a preferred embodiment, the storage container is moved along an axis between a closed position and a dispensing position by a cam. In another preferred embodiment, the storage container is spring loaded, such that the storage container returns to a normally closed position. One or more condiment dispensers can be used to organize such condiments as nutmeg, cinnamon, sugar, and cocoa powder at a coffee station, such as at a gourmet coffee shop.

DETAILED DESCRIPTION OF PREFERRED EMBODIMENTS

Figure 1:
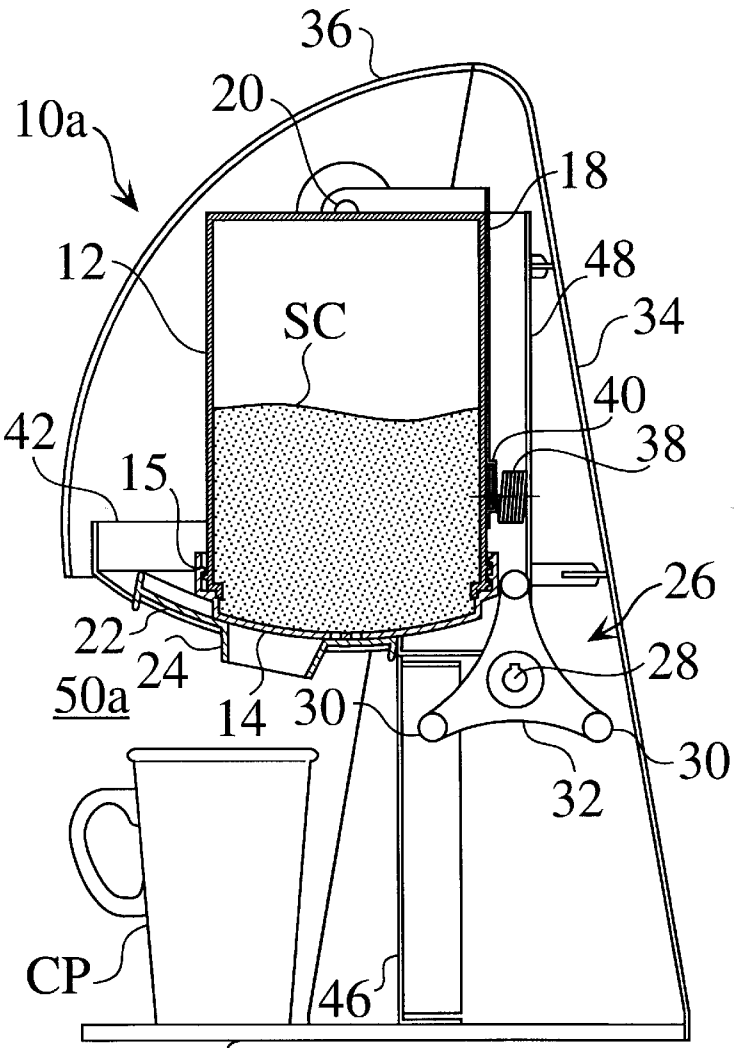
FIG. 1 is a partial cutaway view of a condiment dispensing system in a first resting position.

FIG. 1 is a partial cutaway view of a condiment dispensing system 10*a* in a first resting position 50*a*. A storage container 12 has a hollow volume defined wherein contents SC can be stored. A removable lid 14 is attached to the storage container 12, typically by a threaded or flexible polymer snap seal 15. The lid 14 includes one or more apertures or dispensing holes 16, from which the contents SC within the storage container may be dispensed. The storage container 12 is attached to a container mount 18, which can pivot in relation to a container axis 20.

Figure 2:
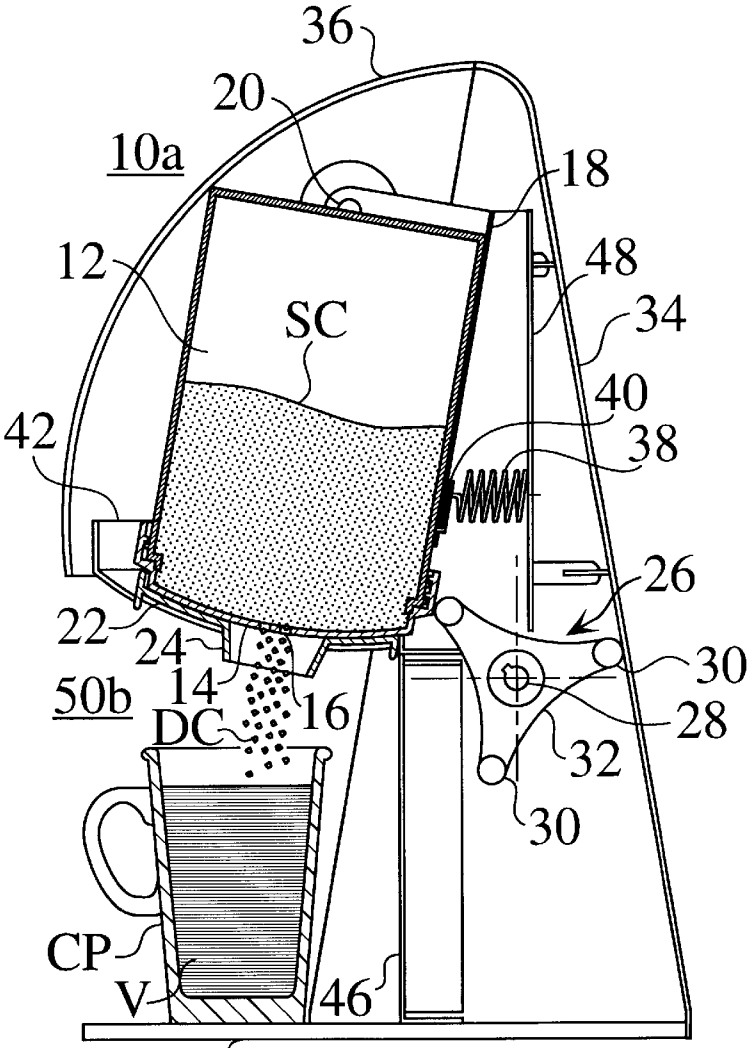
FIG. 2 is a partial cutaway view of a condiment dispensing system in a second dispensing position.

A stationary shutter 22 having a spout 24 is mounted within the condiment dispensing system 10*a*. Movement of the storage container 12 in relation to the container axis 20 allows the dispensing holes 16 to come into alignment with or go out of alignment with the spout 24. When the storage container 12 is located in a first position 50*a*, as shown in FIG. 1, the dispensing holes 16 do not line up with the spout 24 on the shutter 22, and the stored contents SC within the storage container are prevented from being dispensed, such as into a cup CP. As shown in FIG. 2, when the condiment dispensing system 10*a* is located a second dispensing position 50*b*, the dispensing holes 16 line up with the spout 24 on the shutter 22, and the contents SC are allowed to be dispensed DC, such as into a volume of coffee V within a cup CP.

In FIG. 1 and FIG. 2, movement of the storage container 12 between the first position 50*a* and the second position 50*b* is accomplished through the rotational motion of a cam 26 about a cam axis 28, in which the cam 26 has lobes 30 and ramps 32. Movement of the storage container 12 between the first position 50*a* and the second position 50*b* can alternately be accomplished by a variety of mechanisms or actuators, including the use of one or more cams, gears, levers, solenoids, motors, stepper motors and bimetallic devices.

In FIG. 1 and FIG. 2, rotational movement of the cam 26 about the cam axis 28 alternately brings the lobes 30 and ramps 32 into contact with the storage container lid 14. The three-lobed cam 26*a* allows the container 12 to return to a rest position 50*a* three times during one revolution of the cam 26*a*. In the embodiment shown in FIG. 1 and FIG. 2, when the ramps 32 are in contact with the storage container lid 14, the container is in a rest position 50*a*, and when the lobes 30 are in contact with the storage container lid 14, the container is in a dispensing position 50*b*.

In an alternate embodiment, wherein the dispensing holes 16 are located away from the center of the lid 14, when the ramps 32 are in contact with the storage container lid 14, the container is in a dispensing position, and when the lobes 30 are in contact with the storage container lid 14, the container is in a resting position.

The outer structure of the condiment dispensing system 10*a* typically includes a rear housing 34 and a lower housing cover 46 mounted to base 44. The shutter 22 is attached to a stationary shutter mount 42. A removable top housing 36 is attached to the condiment dispensing system 10*a*, typically to the rear housing 34 and to the shutter mount 42. A mechanism mount 48 is attached to the rear housing 34.

In the condiment dispensing system 10*a* shown in FIG. 1 and FIG. 2, a bias spring 38 is preferably mounted between a spring attachment boss 40 on the container mount 18, and the mechanism mount 48. While the bias spring 38 can alternately be attached directly to the storage container 12, connection to the container mount 18 allows the storage container 12 to be removed and replaced from the condiment dispensing system 10 without detachment or attachment of the bias spring 38 from the storage container 12. In the embodiment shown, the bias spring 38 is in a relaxed position when the condiment dispensing system 10*a* is in the first position 50*a*, and is stretched into an extended position when the condiment dispensing system 10*a* is in the second dispensing position 50*b*. When the storage container 12 is moved away from the first resting position 50*a*, the bias spring 38 applies a force to the storage container 12 in the direction of the first resting position 50*a*. The preferred bias spring 38 thus returns the condiment dispensing system 10*a* to the first non-dispensing position 50*a* when the dispensing operation is stopped.

Figure 4:
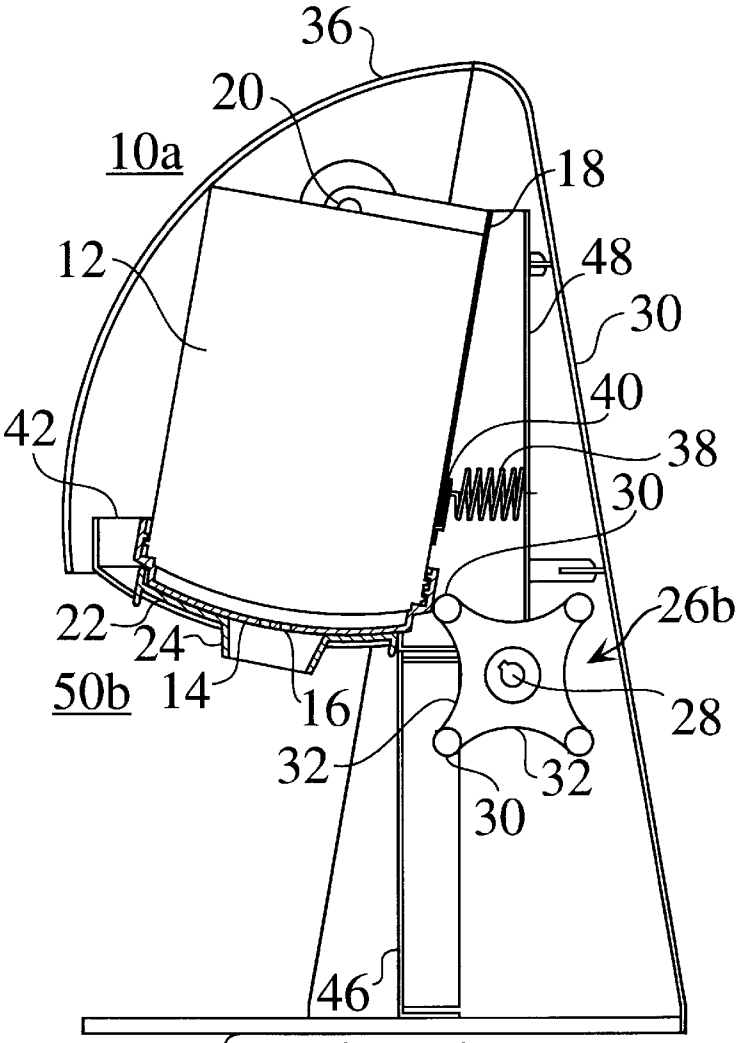
FIG. 4 is a partial cutaway view of an alternate condiment dispensing system in a second dispensing position.
Figure 3:
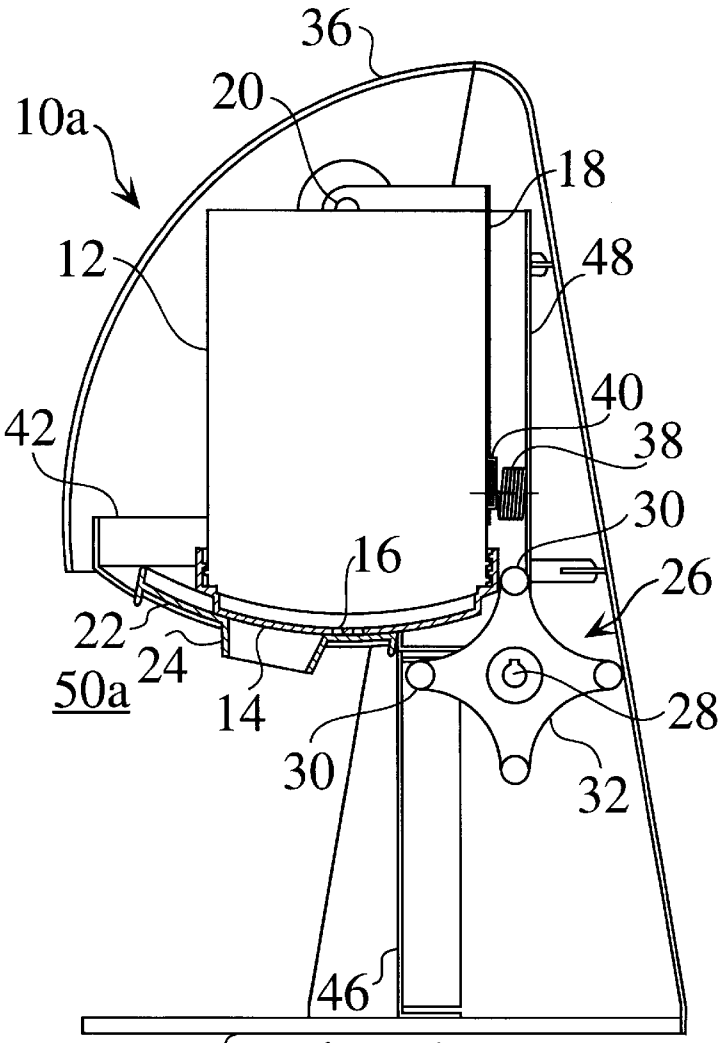
FIG. 3 is a partial cutaway view of an alternate condiment dispensing system in a first resting position.

FIG. 3 and FIG. 4 show partial cutaway views of an alternate condiment dispensing system 10*b* in a first resting position 50*a*, and a second dispensing position 50*b*. The alternate condiment dispensing system 10*b* has a four-lobed cam 26*b*, in which the cam 26*b* has four lobes 30 and four ramps 32. The rotational movement of the cam 26*b* about the cam axis 28 alternately brings the lobes 30 and ramps 32 into contact with the storage container lid 14 four times during one revolution of the cam 26*b*. In other alternate embodiments the cam or drive mechanism can be changed to accommodate more or fewer cycles in one revolution of the cam or gear 26.

A wide variety of condiments can be organized, stored and dispensed by the condiment dispensing system 10. The condiment dispensing system 10 is typically used to dispense such condiments SC as nutmeg, cinnamon, sugar, or cocoa powder. The use of one or more condiment dispensing systems 10 allows the convenient dispensing of condiments within a coffee station, such as a gourmet coffee or tea shop.

Condiment Dispensing Process. The basic condiment dispensing process comprises the following steps:

1. providing a base 44;
2. locating a stationary shutter 22 having a spout 24 over the base 44;
3. locating a storage container 12 over the stationary shutter 22, where the storage container 12 has a lower surface or lid 14, an inner volume 86, and one or more dispensing holes 16 between the inner volume 86 and said lower surface 14; and
4. moving the storage container 12 in relation to the shutter 12 between a first resting position 50*a*, in which the dispensing holes 16 are not in alignment with the spout 24, and a second dispensing position 50*b* in which the dispensing holes 16 are in alignment with the spout 24.

Dispensing Lid and Shutter Components. The condiment dispensing system 10 is easily adapted to dispense various condiments and materials SC, through the use of different lids 14 and shutters 22. The four primary condiments SC that are commonly dispensed by the condiment dispensing system 10 are sugar, ground cinnamon, ground nutmeg, and cocoa. Some condiments or dispensed materials SC require a larger stored volume 86 (FIG. 15) than others, due either to their frequency of use, or to the dispensed volume DC of condiment within each portion. FIGS. 5 through 10 provide perspective views of various combinations of lid holes 16, hole patterns 52 and shutter spouts 24, which provide precise and customizable control for the quantity and pattern of dispensed condiments DC.

Figure 5:
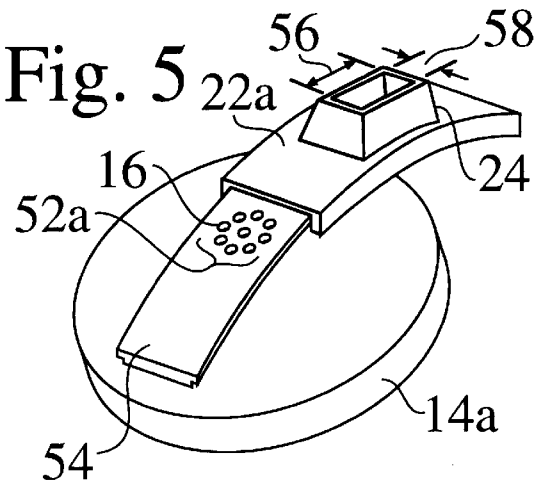
FIG. 5 is a perspective view of a nine-orifice lid coupled with a long duration, narrow dispensing shutter.

FIG. 5 is a perspective view of a nine-orifice lid 14*a* coupled with a long duration, narrow dispensing shutter 22*a*. The lid 14*a* has a series of nine dispensing holes 16 in a circular pattern 52*a*. A slide structure 54 is included on the lid 14*a*, which allows the lid 14*a* to move in relation to the shutter 22*a*. The dispensing spout 24 on the shutter 22*a* has a long spout length 56, which results in a long duration of dispensing the stored condiment SC, as holes 16 come into alignment with the spout 24. The dispensing spout 24 also has a narrow spout width 58, which results in a narrow dispensing area for the dispensed condiment DC, as holes 16 come into alignment with the spout 24.

Figure 6:
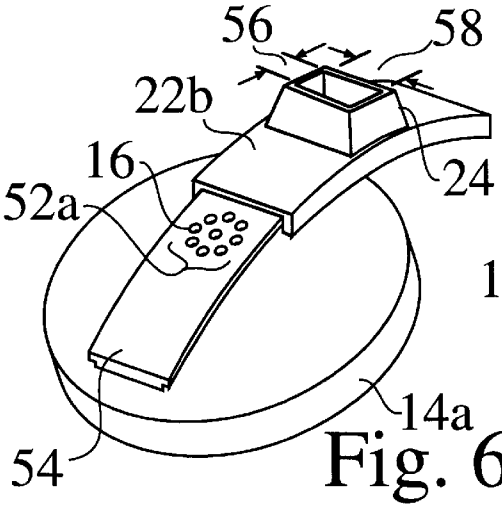
FIG. 6 is a perspective view of a nine-orifice lid coupled with a short duration, wide dispensing shutter.

FIG. 6 is a perspective view of a nine-orifice lid 14*a* coupled with a short duration, wide dispensing shutter 22*b*. The dispensing spout 24 on the shutter 22*b* has a narrow spout length 56, which results in a short duration of dispensing the stored condiment SC, as holes 16 come into alignment with the spout 24. The dispensing spout 24 also has a wide spout width 58, which results in a wide dispensing area for the dispensed condiment DC, as holes 16 come into alignment with the spout 24.

Figure 7:
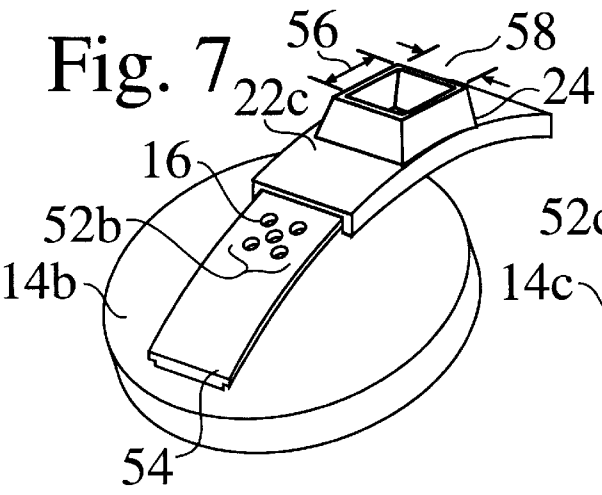
FIG. 7 is a perspective view of a five-orifice lid coupled with a long duration, wide dispensing shutter.

FIG. 7 is a perspective view of a five-orifice lid 14*b* coupled with a long duration, wide dispensing shutter 22*c*. The lid 14*b* has a series of five dispensing holes 16 in a circular pattern 52*b*. In contrast to the circular pattern 52*a* of nine smaller holes 16, the circular pattern 52*b* has only five holes 16, and each of the holes has a slightly larger diameter. The pattern 52 and diameter of holes 16 are chosen to provide adequate dispensing for different stored condiments SC.

The dispensing spout 24 on the shutter 22*c* has a long spout length 56, which results in a long duration of dispensing the stored condiment SC, as holes 16 come into alignment with the spout 24. The dispensing spout 24 also has a wide spout width 58, which results in a wide dispensing area for the dispensed condiment DC, as the holes 16 come into alignment with the spout 24.

Figure 8:
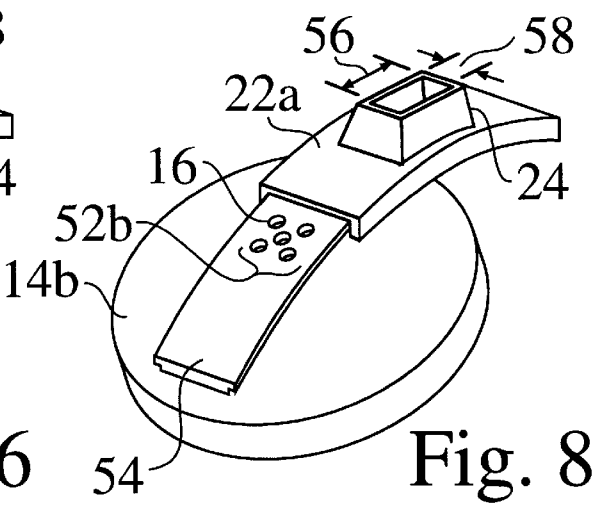
FIG. 8 is a perspective view of a five-orifice lid coupled with a long duration, narrow dispensing shutter.

FIG. 8 is a perspective view of a five-orifice lid 14*b* coupled with a long duration, narrow dispensing shutter 22*a*. The dispensing spout 24 on the shutter 22*a* has a long spout length 56, which results in a long duration of dispensing the stored condiment SC, as holes 16 come into alignment with the spout 24. The dispensing spout 24 also has a narrow spout width 58, which results in a narrow dispensing area for the dispensed condiment DC, as the holes 16 come into alignment with the spout 24.

Figure 9:
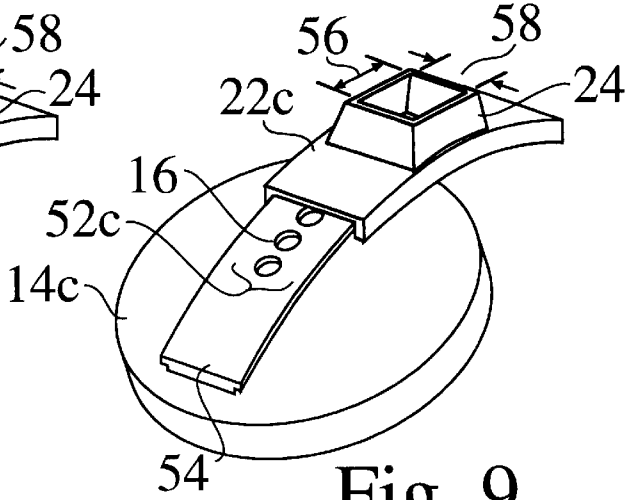
FIG. 9 is a perspective view of a three inline orifice lid coupled with a long duration, wide dispensing shutter.
Figure 10:
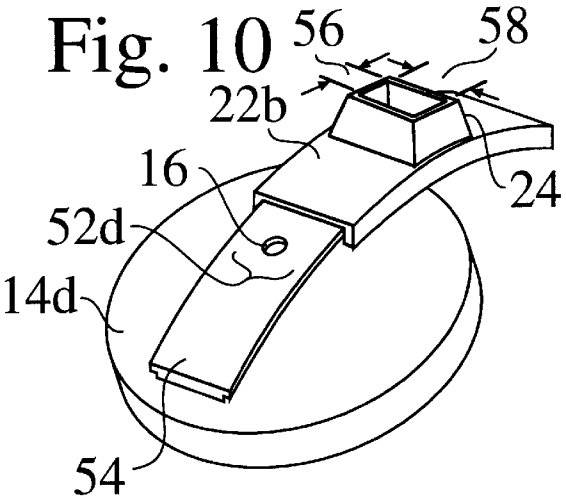
FIG. 10 is a perspective view of a single-orifice lid coupled with a short duration, wide dispensing shutter.

FIG. 9 is a perspective view of an alternate three inline orifice lid 14*c* coupled with a long duration, wide dispensing shutter 22*c*. The lid 14*c* has a series of three dispensing holes 16 in a linear pattern 52*c*. FIG. 10 is a perspective view of a single-orifice lid 14*d* coupled with a short duration, wide dispensing shutter 22*b*. The lid 14*d* has a large single dispensing hole 16 in a pattern 52*d*.

Figure 11:
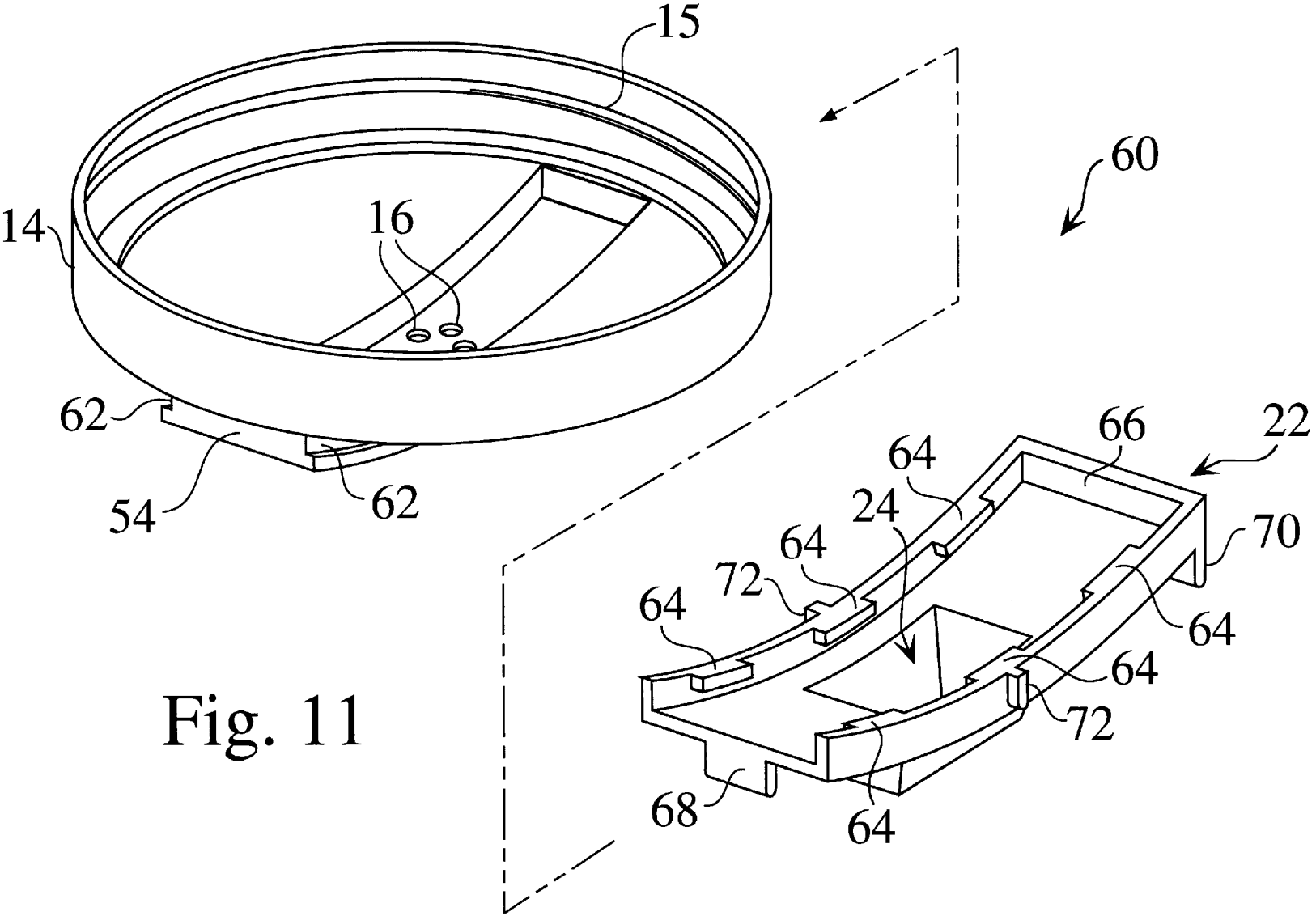
FIG. 11 is a bottom expanded perspective view of a lid and dispensing shutter assembly.

Lid and Shutter Movement. FIG. 11 is a bottom expanded perspective view of a lid 14 and dispensing shutter 22. In this embodiment, the lid includes a slide structure 54 with ramps 62, which allows the lid 14 to move in relation to the shutter 22. The shutter 22 has slide tabs 64, which confine the slide structure 54 and ramps 62 on the lid 14. The shutter 22 preferably has a slide stop 66, which limits the sliding motion of the storage canister 12 and the lid 14, in relation to the shutter 22. The shutter 22 is typically mounted in a stationary position within the housing structure of the condiment dispenser system 10, using a rear locator tab 68, side locator tabs 72, and a front locator tab 70. Proper positioning of the shutter 22 within the condiment dispenser system 10 ensures that storage container 12 and lid 14 are allowed to be moved properly from a first resting position 50*a* to a second dispensing position 50*b*, such as by a cam 26 (FIGS. 1–4).

Figure 12:
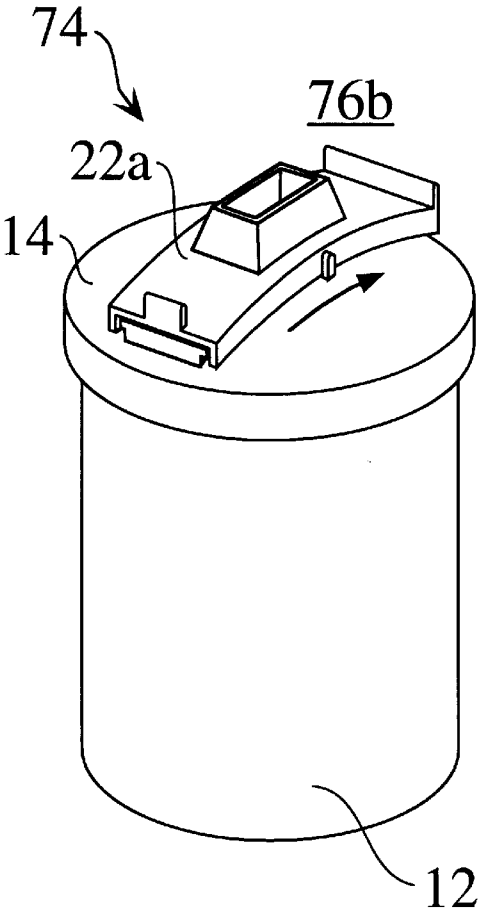
FIG. 12 is a perspective view of a storage container and lid coupled with a long duration, narrow dispensing shutter in a second dispensing position.

FIG. 12 is a perspective view 74 of a storage container 12 and lid 14 coupled with a long duration, narrow dispensing shutter 22*a* in a second dispensing position 76*b*. As shown in FIG. 11, the shutter 22*a* is slidably mounted to the lid 12, by slide tabs 64, which move along ramps 62 on slide structure 54. In the second dispensing position 76*b*, the spout 24 on the shutter 22*a* is aligned with holes 16 on the lid 14.

Figure 13:
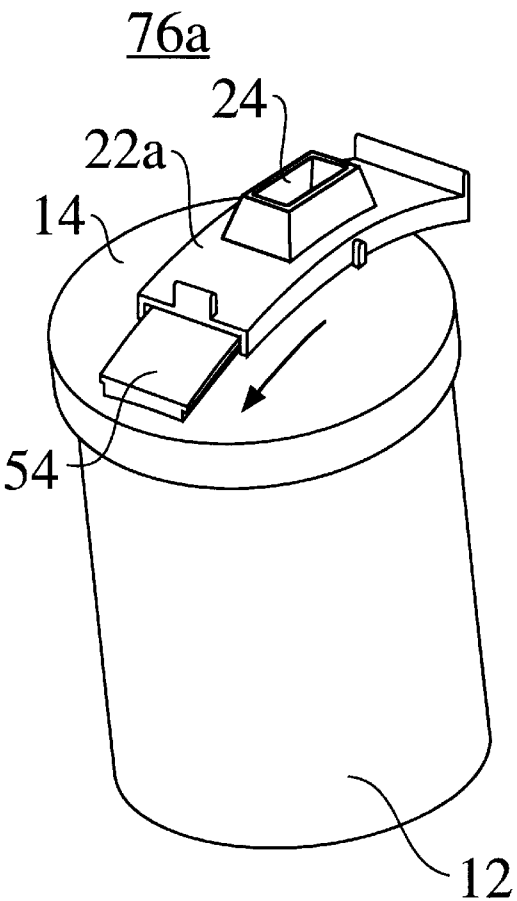
FIG. 13 is a perspective view of a storage container and lid coupled with a long duration, narrow dispensing shutter in a first resting position.

In FIG. 13, the storage container 12 and lid 14 of FIG. 12 are moved to a resting position 76*a* in relation to the stationary shutter 22*a*. In the resting position 76*b*, the spout 24 on the shutter 22*a* is not aligned with holes 16 on the lid 14, which prevents condiments SC from being dispensed.

Figure 14:
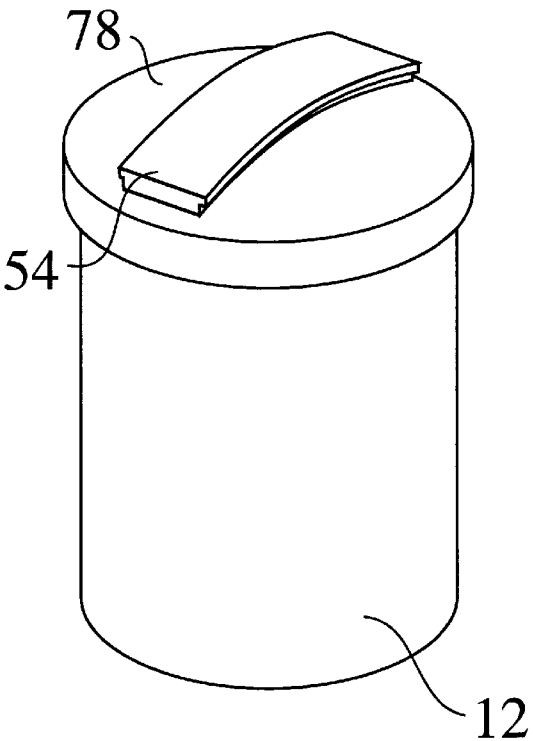
FIG. 14 is a perspective view of a storage container and a non dispensing lid.

FIG. 14 is a perspective view of a storage container 12 and a non-dispensing lid 78. The non-dispensing lid 78 is commonly used for storage and shipment of new condiments SC, or for shipment of the condiment dispensing system 10.

Figures 15, 16, 17:
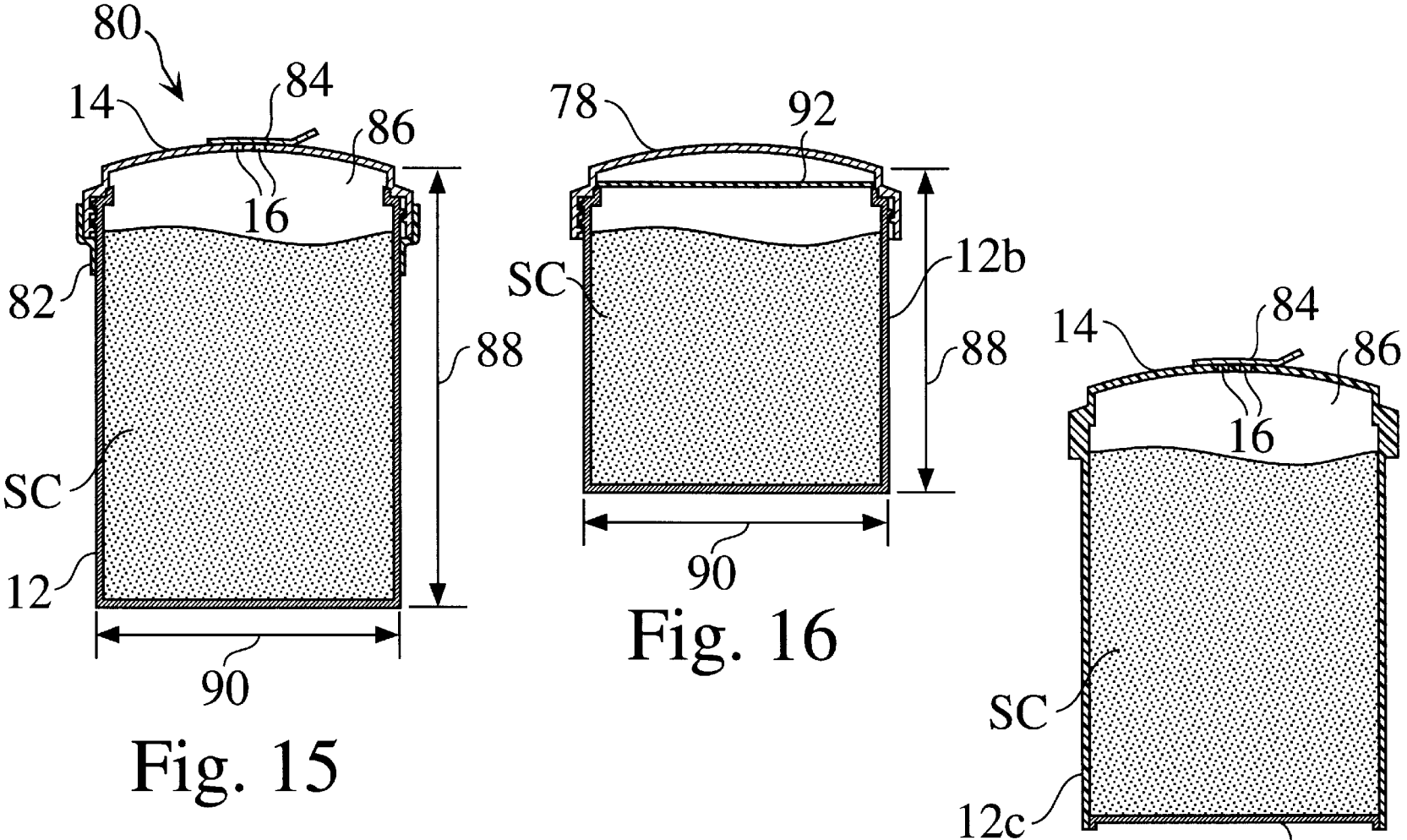
FIG. 15 is a cross-sectional view of a sealed storage container.
FIG. 16 is a cross-sectional view of a sealed small volume storage container, with a non-dispensing lid, and an adhesive tamper-resistant seal underneath the lid.
FIG. 17 shows an alternate embodiment of the storage container, in which a dispensing lid is integral to the storage container.

FIG. 15 is a cross-sectional view of a sealed storage container 12. When new storage containers 12 are supplied with fresh condiments SC stored inside volume 86, it is preferred to seal the storage container 12, to maintain freshness of the condiment SC, and to provide a tamper-resistant barrier. In the embodiment shown in FIG. 15, an adhesive dispensing seal 84 covers dispensing holes 16, and a removable ring seal 82 protects the outer region where the lid 14 is attached to the storage container 12, providing an indication if the lid 14 has been removed from the storage container 12. When the storage container 12 is placed within the condiment dispensing system, the user removes the adhesive dispensing seal 84 before sliding the shutter 22 onto the lid 14. FIG. 16 is a cross-sectional view of a sealed small volume storage container 12*b*, with a non-dispensing lid 78, and an adhesive tamper-resistant seal 92 underneath the lid 78. Before the storage container 12 is placed within the condiment dispensing system 10, the user removes non-dispensing lid 78 and the adhesive tamper-resistant seal 92. The user then attaches the desired dispensing lid 14, slides the shutter 22 onto the dispensing lid 14, and places the storage container 12, lid 14, and shutter 22 within the condiment dispensing system 10.

Due to the cost difference and the dispensed volume DC of each stored condiment SC, it is preferred that containers 12 of different volumes 86 are available and are compatible with dispensing lids 14 and non-dispensing lids 78. In the embodiments shown in FIGS. 15 and 16, the storage containers 12 and 12*b* have the same diameter 90, but with different heights 88. The storage containers 12 and 12*b* are interchangeable, allowing different volumes 86 of stored condiments SC. The use of different storage containers 12 having different volumes 86 also allows less frequently consumed condiments SC to remain fresh.

FIG. 17 shows an alternate embodiment of the storage container 12*c*, in which a dispensing lid 14*e* is integral to the storage container 12*c*. The storage container is filled with condiment SC, and is then sealed with a lower seal 94. An adhesive dispensing seal 84 covers dispensing holes 16. When the storage container is placed within the condiment dispensing system 10, the user removes the adhesive dispensing seal 84 before sliding the shutter 22 onto the lid 14*e*. While the integral storage container 12*c* is typically filled and used once, it provides a high level of tamper-resistance, and ensures that the dispensing holes 16 and hole pattern 52 are compatible with the stored condiment SC.

Storage Container Configuration and Materials. While the storage containers 12 can be any shape (i.e. square, rectangular, cylindrical), many shapes and sizes are currently available as standard sizes from a variety of manufacturers.

It is preferred to use high grade materials, such as food grade polymers, for the storage container 12, the lid 14, and the shutter 22. Food grade polymers are compatible with the stored condiments SC, and do not impart any taste to the stored condiments SC. Several polymers are currently available as preferred food grade resins, and are capable of being processed into blow-molded or extruded blow-molded storage containers 12, or into either a screw-top or snap-neck top lid 14. Preferred polymers include polyethylene terephthalate (PET), high density polyethylene (HDPE), and clear polyvinyl chloride (PVC).

Figure 18:
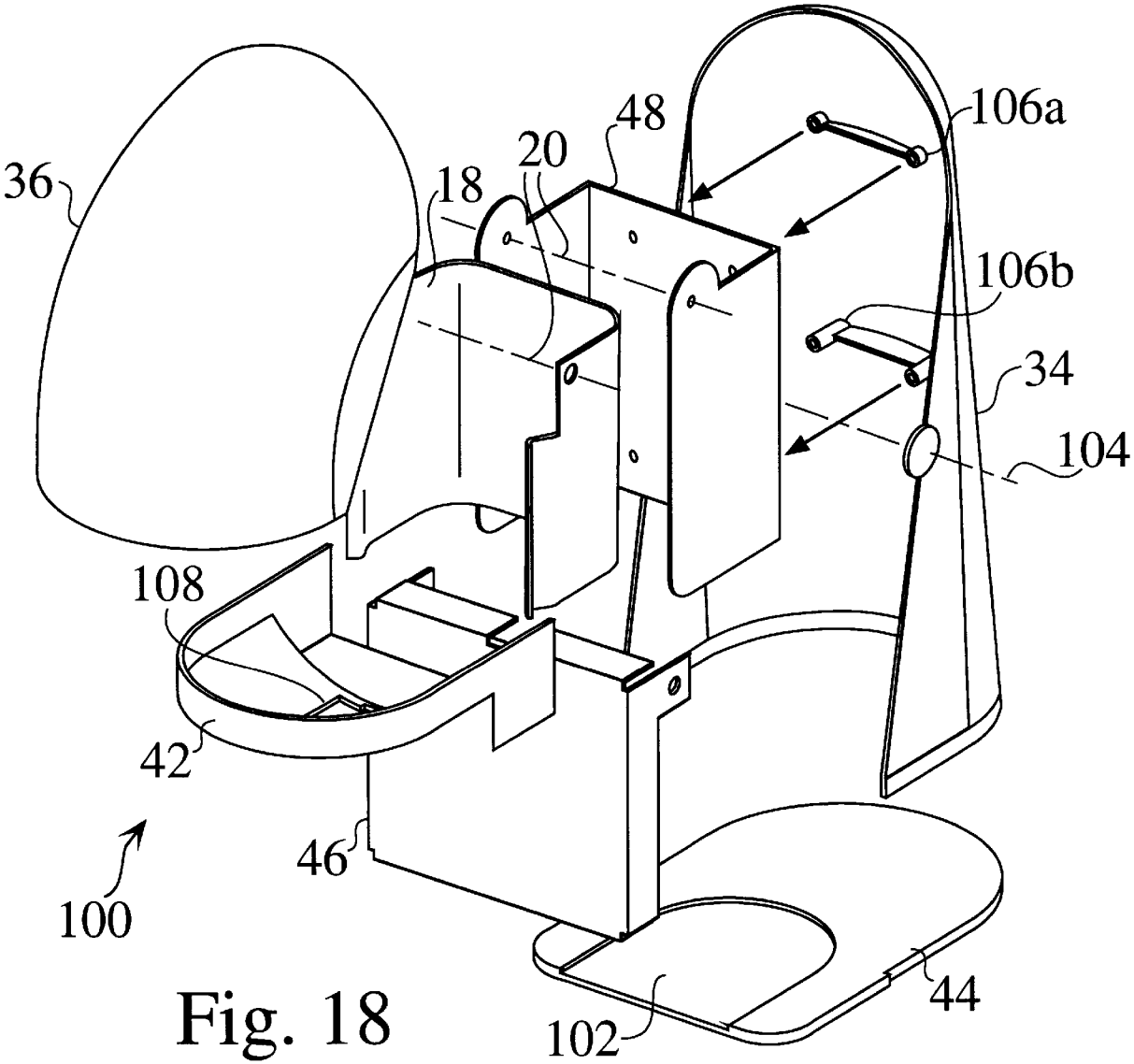
FIG. 18 is an expanded view of the housing structure of a single condiment dispenser.

Housing Structure. FIG. 18 is an expanded view 100 of the housing structure of a single condiment dispenser 10. The base 44 includes a cup receptacle 102, onto which a user can precisely locate a cup CP underneath the spout 24. The rear housing 34 and the lower housing cover 46 are mounted to the base 44. The lower housing cover 46 is located above the baseplate 44, behind the cup receptacle 102.

The stationary shutter mount 42 is attached to the lower housing cover 42. The stationary shutter mount 42 has a mounting hole 108, wherein the shutter 22 is located. The mechanism mount 48, having a container axis 20, is attached to the rear housing 34 by upper bosses 106*a* and lower bosses 106*b*. The removable top housing 36 is rotatably attached to the rear housing 34 at pivot 104.

The container mount 18 is attached to mechanism mount 48 along the container axis 20, and can pivot in relation to the container axis 20. The storage container 12, having a lid 14, is attached to the container mount 18, and can also pivot with the container mount along the container axis 20.

Figure 19:
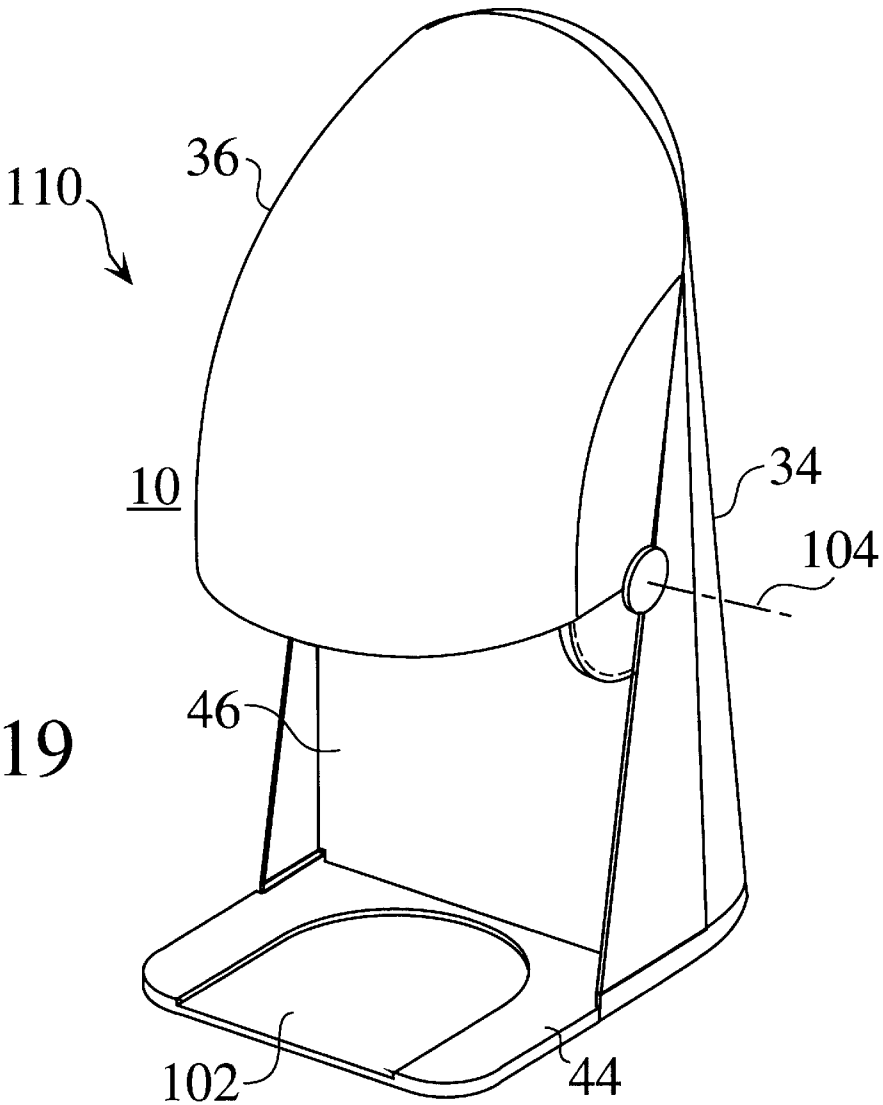
FIG. 19 is a perspective view of an assembled single condiment dispenser.

FIG. 19 is a perspective view 110 of an assembled single condiment dispenser 10, wherein the top housing 36 is rotatably attached to the rear housing 34 at pivot 104. Rotation of the top housing 36 allows access to the storage container 12, so that the user can remove or replace storage containers 12.

Figure 21:
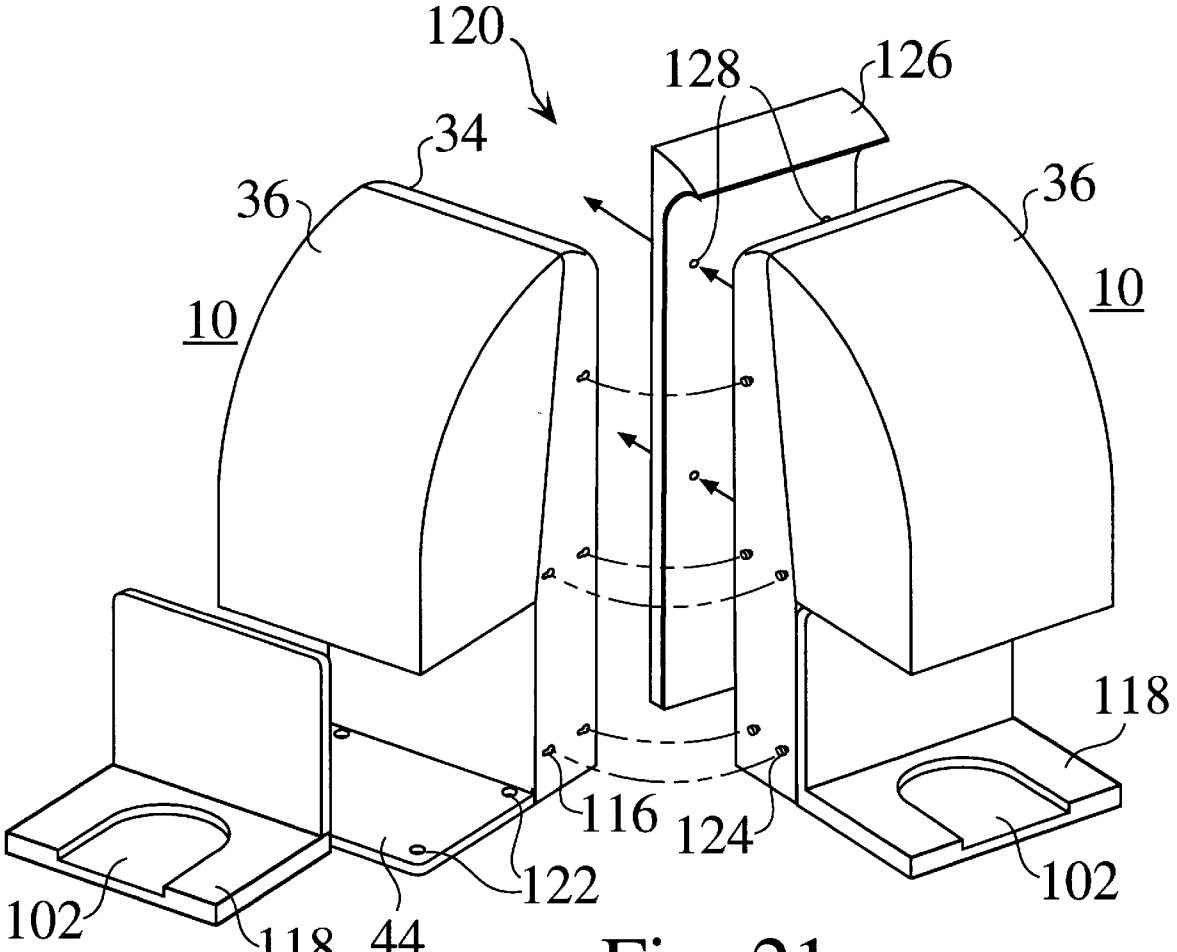
FIG. 21 is a perspective assembly view showing wall attachment and gang attachment details for the mountable condiment dispenser.

Condiment System Installation. It is preferred that the condiment dispensing system 10 be attached directly to a solid surface, such as a wall, countertop, or shelf. The condiment dispensing system 10 can either be attached directly to a surface, or can be attached by an intermediate bracket 126 (FIG. 21). The mounting method is preferably covered or hidden from the user, for appearance and for ease of cleaning.

Figure 20:
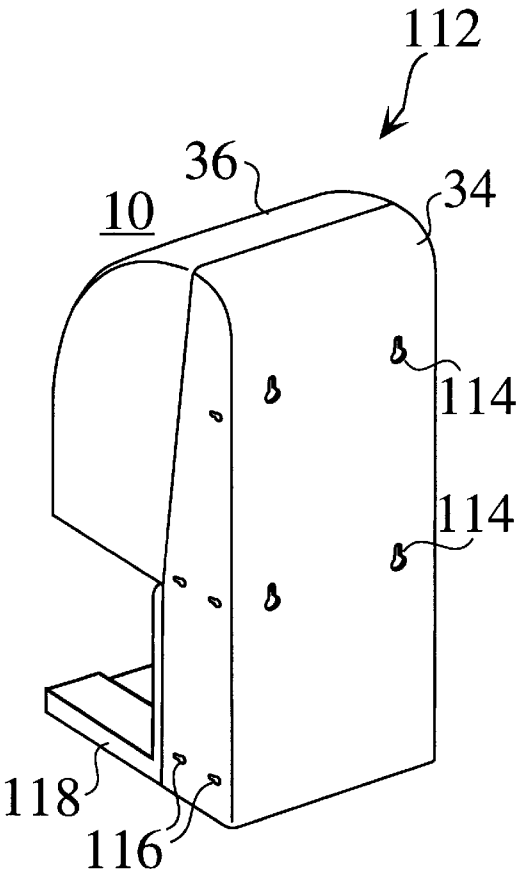
FIG. 20 is a rear perspective view of an assembled mountable condiment dispenser.

FIG. 20 is a rear perspective view 112 of an assembled mountable condiment dispenser 10. The rear housing 34 includes rear mount holes 114, which allow the condiment dispenser 10 to be mounted to a vertical surface, such as to a wall or to a wall bracket 126. The rear housing 34 also includes side mount holes 116, which allows the mountable condiment dispenser 10 to be attached sideways to a wall, to a bracket, or to another condiment dispenser 10. A preferred removable baseplate cover 118, having a cup receptacle 102, allows the baseplate 44 to be attached inconspicuously to a horizontal surface, such as a countertop or shelf.

FIG. 21 is a perspective assembly view 120 showing wall attachment and gang attachment details for the mountable condiment dispenser 10. Condiment dispensers 10 can be attached to a mounting bracket 126 by dispenser attachments 128. The mounting bracket 126 can be attached to either a wall or another vertical surface. Condiment dispensing units 10 can also be ganged together, whereby a variety of materials SC can be dispensed. One side of the rear housing 34 of a first condiment dispenser 10 has side mount holes 116, while the mating side of an adjoining condiment dispenser has side mount bosses 124. The side mount bosses 124 and side mount holes 116 interlock to connect the condiment dispensers 10.

Figure 22:
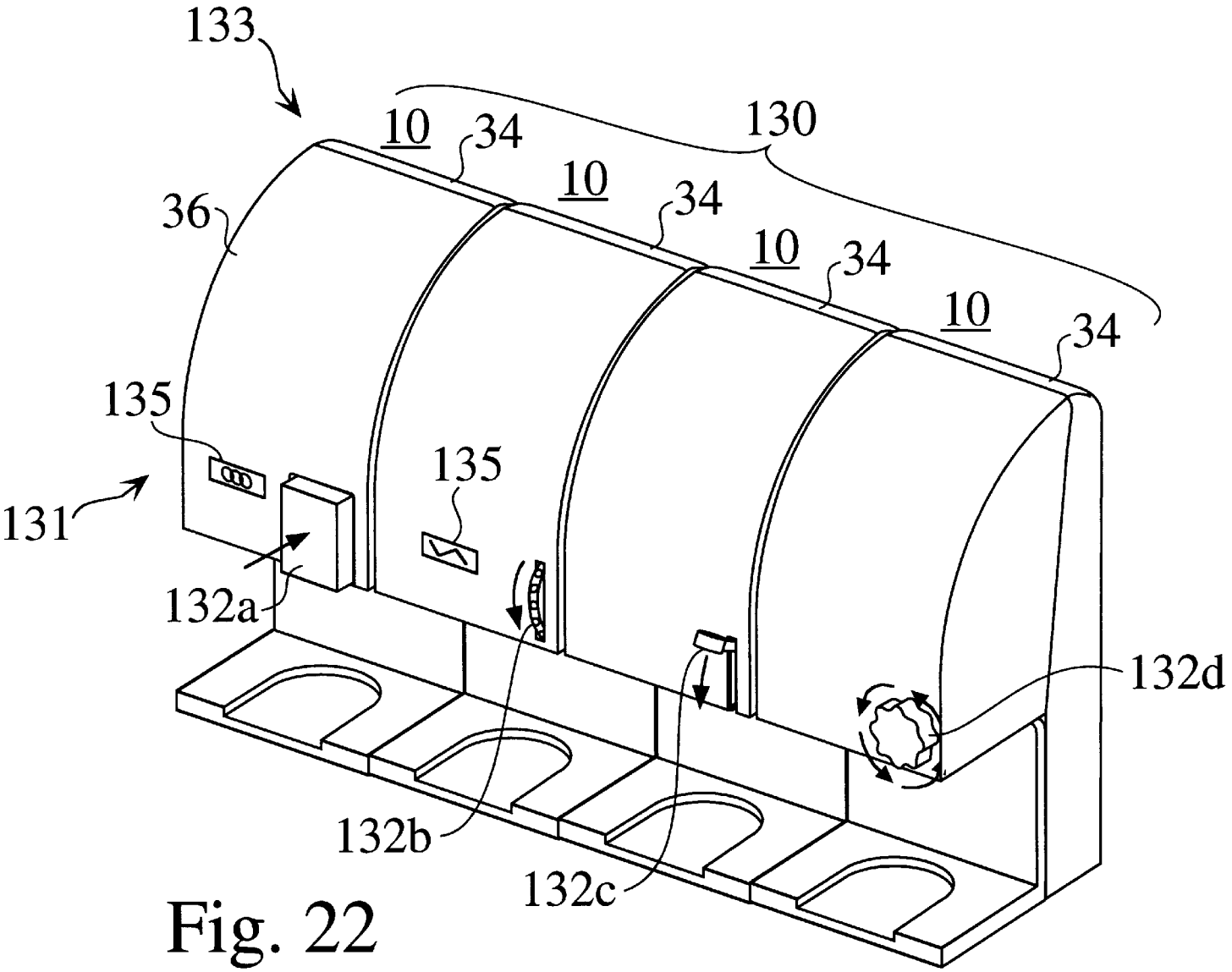
FIG. 22 is a perspective view of a dispensing station comprising a plurality of attached condiment dispensers.

FIG. 22 is a perspective view of a dispensing station 130 comprising a plurality of attached condiment dispensers, whereby a variety of materials SC can be dispensed. FIG. 22 also demonstrates a variety of actuators 132 that can be used to actuate the dispensing units 10, such as a button actuator 132*a*, a dial actuator 132*b*, a lever actuator 132*c*, or a lever actuator 132*d*. For dispensing units 10 that are ganged together in a side to side configuration, the actuators 132 are preferably accessible from the front side 131 or the top side 133 of the dispensing units 10, so that there is no impedance of use. As well, nameplates or icons 135 are preferably used to identify the stored condiment SC within each condiment dispenser 10.

Dispenser Activation. There are several ways to drive the rotatable cam 26 to move the condiment dispensing system 10 between a resting position 50*b* and a dispensing position 50*a*. The condiment dispensing system 10 is typically directed to move between a resting position 50*b* and a dispensing position 50*a* by a variety of actuators 132, which are connected to the rotatable cam 26, as described above. Mechanisms such as gears and levers typically translate the movement of an actuator 132 into the rotational movement of the cam 36. Alternately, a switched electrical motor connected directly or indirectly to the cam 36 can be used to move the condiment dispensing system 10 between the resting position 50*b* and the dispensing position 50*a*.

Figure 23:
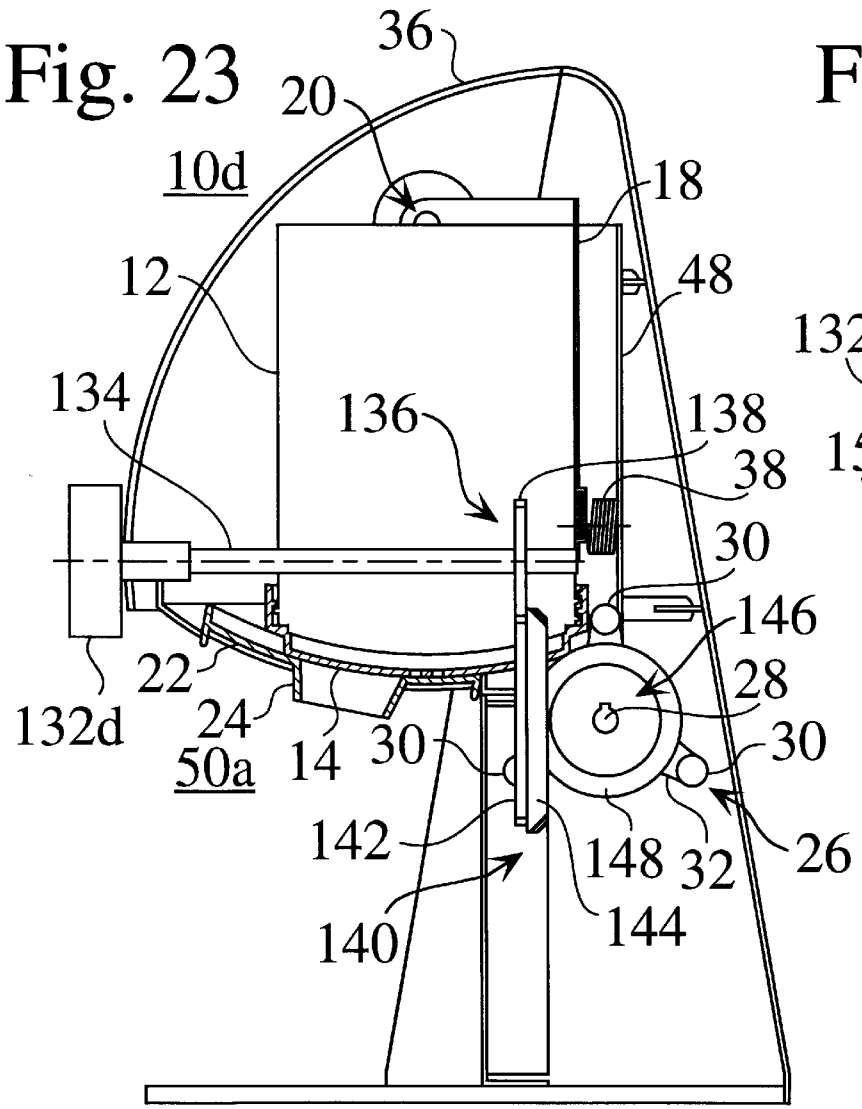
FIG. 23 is a partial cutaway view of a condiment dispensing system having a knob actuator in a first resting position.

FIG. 23 is a partial cutaway view of a condiment dispensing system 10*d*, in a first resting position 50*a*, having a knob actuator 132*d*. The knob actuator 132*d* is connected to a shaft 134. A first drive gear 136, having first inline gear teeth 138, is also connected to the shaft 134. The first drive gear 136 is engaged with second inline gear teeth 142 on a second drive gear 140. The second drive gear 140 also has beveled gear teeth 144, which engage with a beveled actuator gear 146 on a third drive gear 146. The third drive gear 146 is mounted on the cam axis 28, so that rotational motion of the knob actuator 132*d* by a user serves to rotate the rotatable cam 26, moving the condiment dispensing system 10*d* between a resting position 50*b* and a dispensing position 50*a*.

Figure 24:
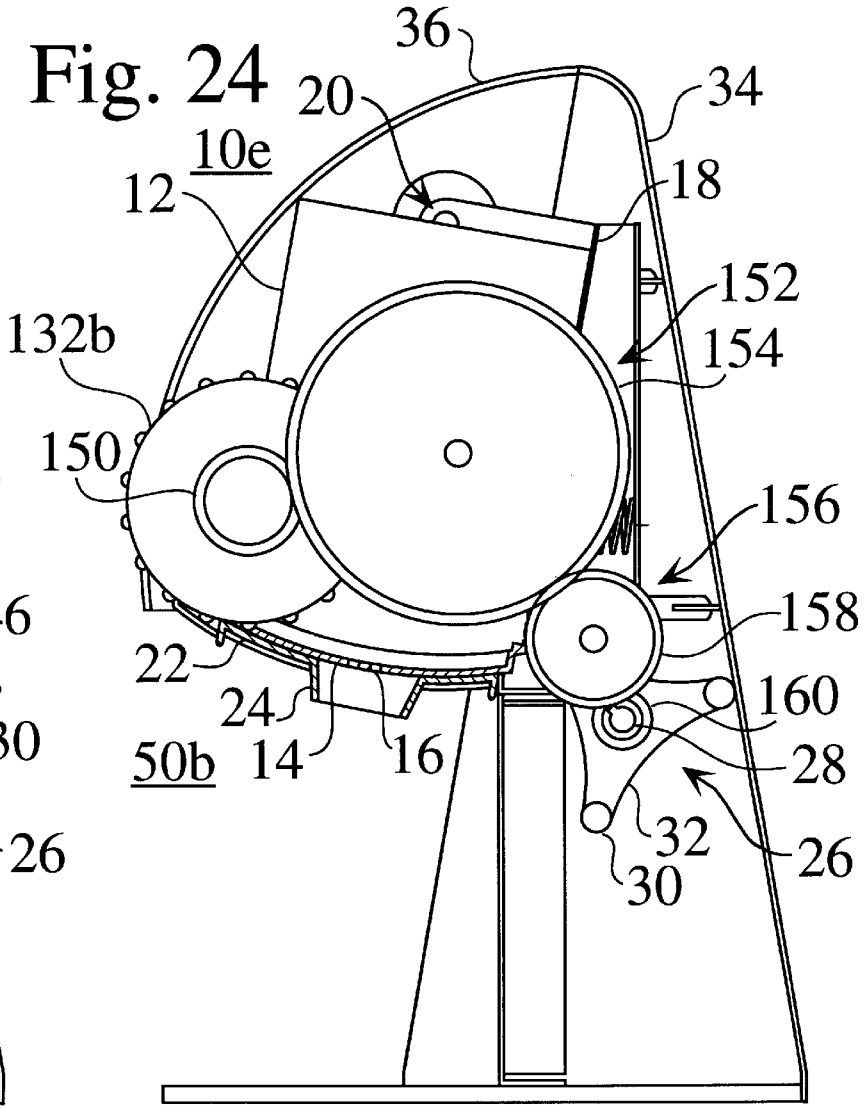
FIG. 24 is a partial cutaway view of a condiment dispensing system having a vertical dial actuator in a second dispensing position.

FIG. 24 is a partial cutaway view of an alternate condiment dispensing system 10*e*, in a second dispensing position 50*b*, having a vertical dial actuator 10*e*. The dial actuator 10*e*, having first dial drive gear 150, is engaged with the second dial drive teeth 154 of a second dial drive gear 152. The second dial drive teeth 154 are engaged with the third dial drive teeth 158 of a third dial drive gear 156. The third dial drive teeth 158 are also engaged with cam drive gear 160, which is mounted on the cam axis 28, so that rotational motion of the dial actuator 10*e* by a user serves to rotate the rotatable cam 26, moving the condiment dispensing system 10*e* between a resting position 50*a* and a dispensing position 50*b*.

Figure 26:
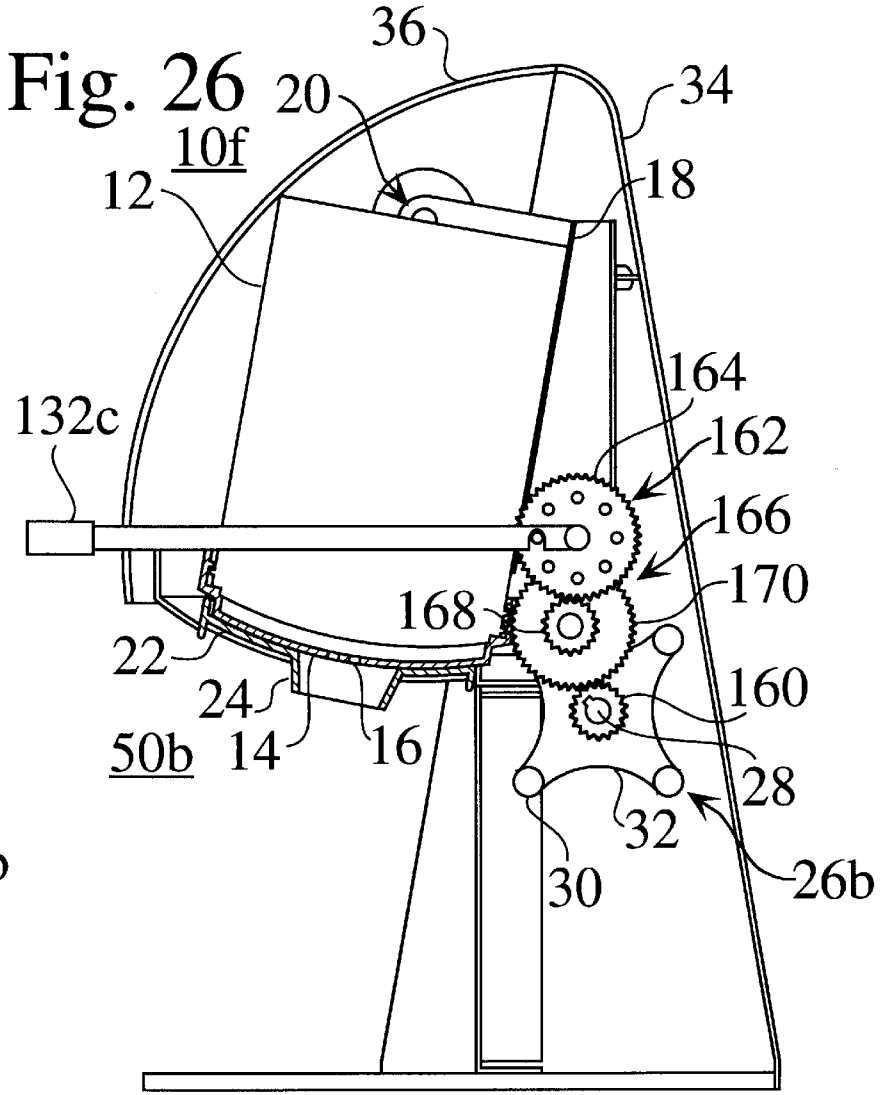
FIG. 26 is a partial cutaway view of a condiment dispensing system having a vertical lever actuator in a second dispensing position.
Figure 25:
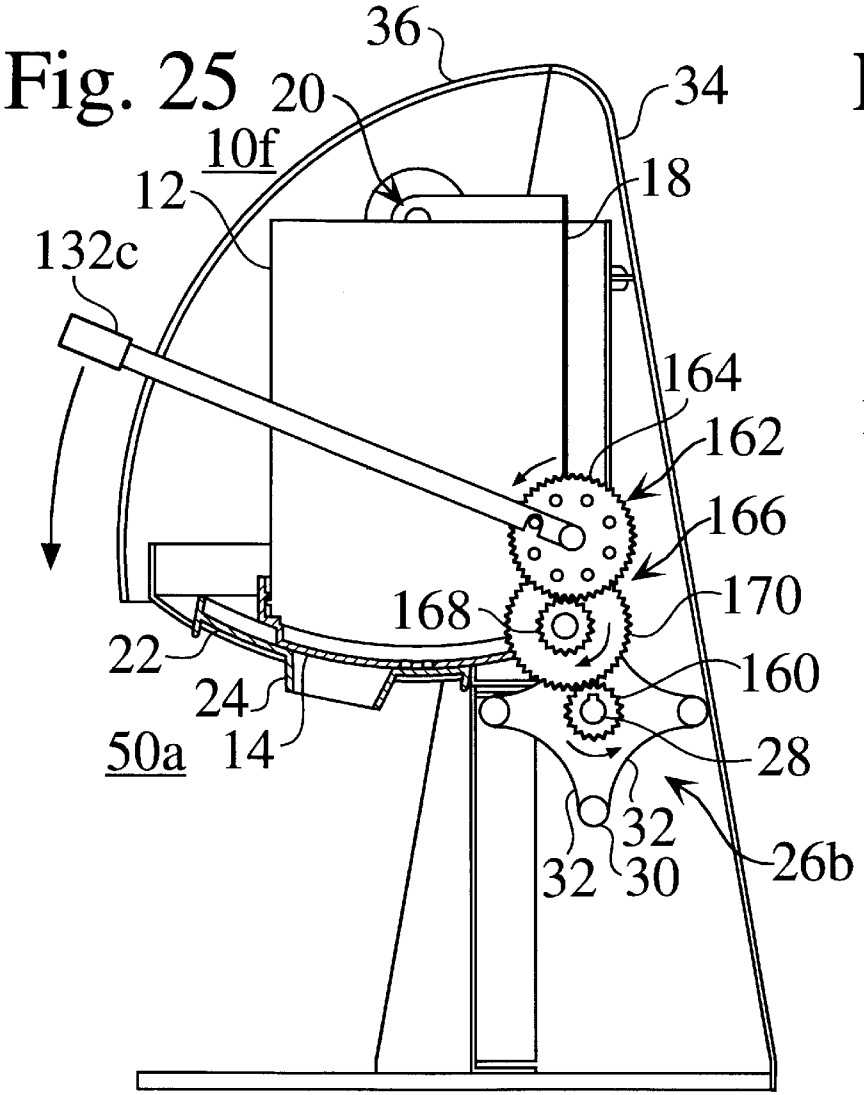
FIG. 25 is a partial cutaway view of a condiment dispensing system having a vertical lever actuator in a first resting position.

FIG. 25 is a partial cutaway view of an alternate condiment dispensing system 10*f* having a vertical lever actuator 132*c* in a first resting position 50*a*. FIG. 26 is a partial cutaway view of the condiment dispensing system 10*f* in the second dispensing position 50*b*. The lever actuator 132*c* operates a single cycle of the cam 26, to drive the condiment dispensing system 10*f* between a resting position 50*b* and a dispensing position 50*a*. The lever actuator 132 is connected to a first lever drive gear 162 having first lever drive gear teeth 164. The first lever drive gear teeth 164 are engaged with drive gear teeth 168 on a second drive gear 166. The second drive gear 166 also has actuator drive gear teeth 170, which are engaged with cam drive gear 160, which is mounted on the cam axis 28. Rotational motion of the vertical actuator 10*f* by a user serves to rotate the rotatable cam 26, moving the condiment dispensing system 10*e* between a resting position 50*a* and a dispensing position 50*b*.

Figure 27:
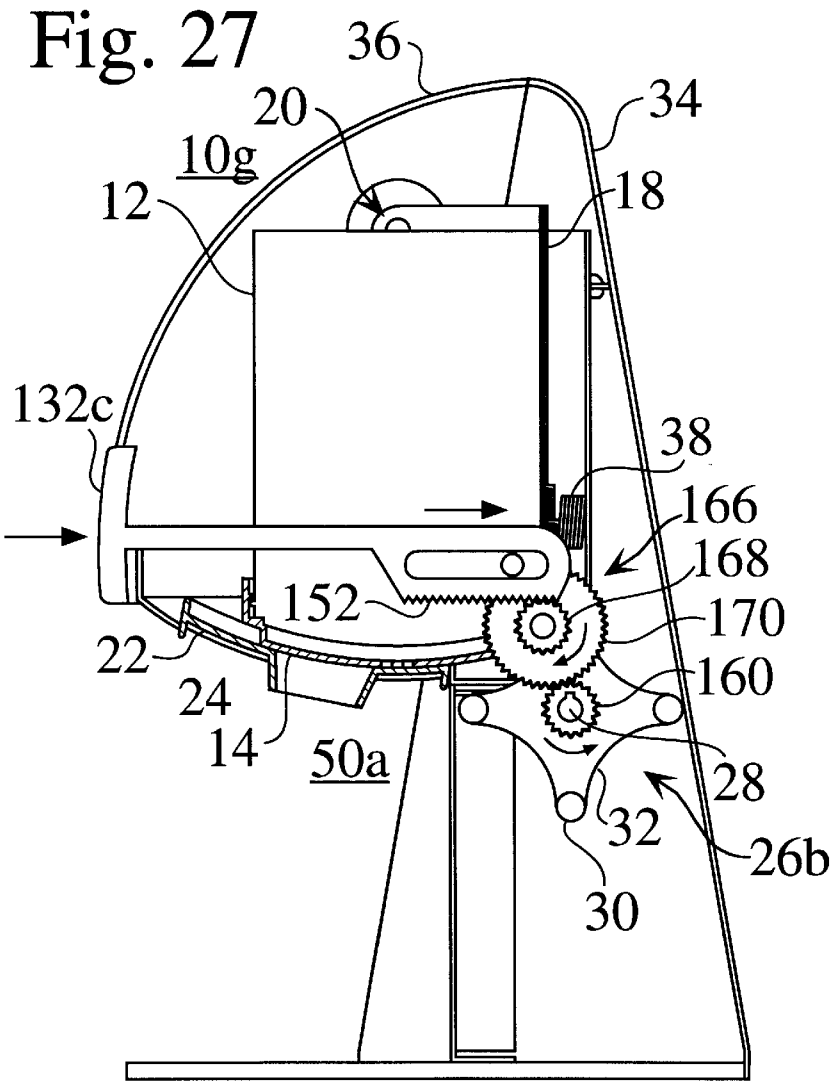
FIG. 27 is a partial cutaway view of a condiment dispensing system having a front push actuator in a first resting position.

FIG. 27 is a partial cutaway view of a condiment dispensing system 10*g*, in a first resting position 50*a*, having a front push actuator 132*c*. The front push actuator 132*c* includes inline gear teeth 152, which are engaged with drive gear teeth 168 on a second drive gear 166. The second drive gear 166 also has actuator drive gear teeth 170, which are engaged with cam drive gear 160. Linear motion of the front push actuator 10*g* by a user serves to rotate the rotatable cam 26, moving the condiment dispensing system 10*e* between a resting position 50*a* and a dispensing position 50*b*.

Figure 28:
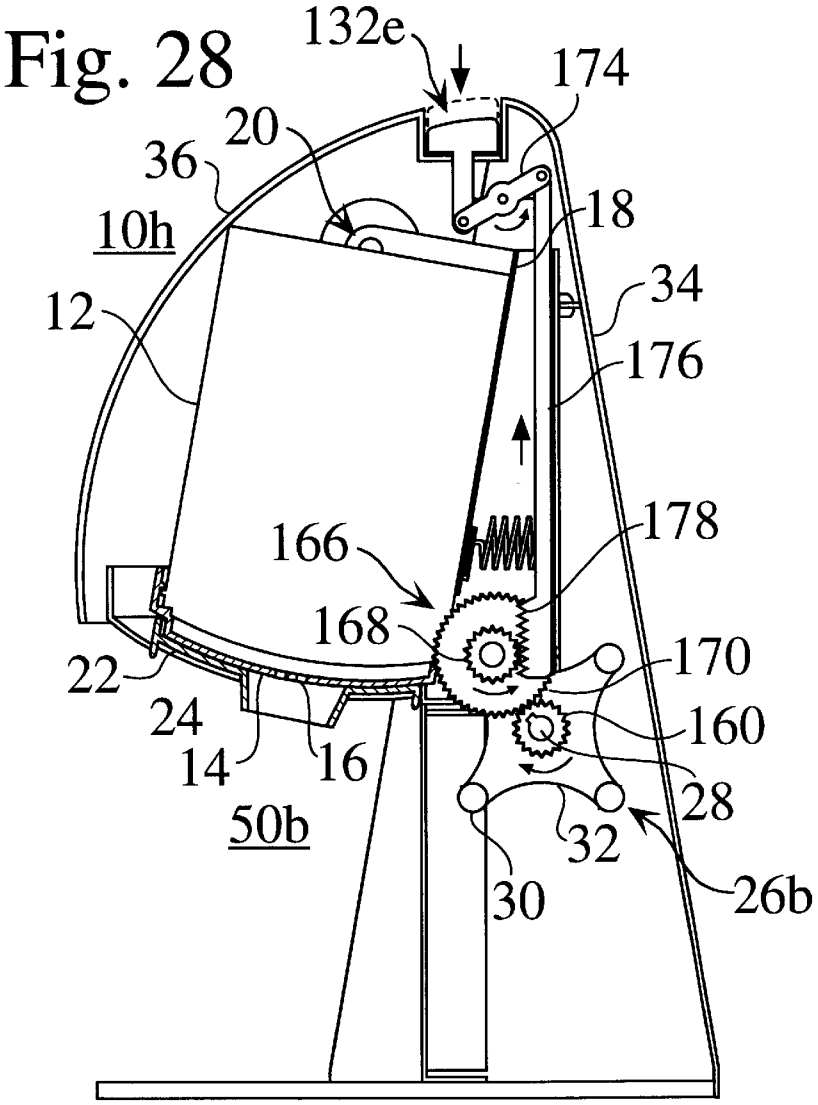
FIG. 28 is a partial cutaway view of a condiment dispensing system having a top push actuator in a second dispensing position.

FIG. 28 is a partial cutaway view of a an alternate condiment dispensing system 10*h*, in a second dispensing position 50*b*, having a top push actuator 132*e*. The top push actuator 132*e* is pivotally linked to a link arm 174, which is pivotally attached to the rear housing 34. A vertical link 176 is also pivotally linked to the link arm 174, and includes vertical inline gear teeth 178, which are engaged with drive gear teeth 168 on a second drive gear 166. The second drive gear 166 also has actuator drive gear teeth 170, which are engaged with cam drive gear 160. Vertical linear motion of the top push actuator 132*e* by a user serves to rotate the rotatable cam 26, moving the condiment dispensing system 10*e* between a resting position 50*a* and a dispensing position 50*b*. As described above, the bias spring 38 returns the system 10 to the resting position 50*a*.

While the storage container 12 is generally moved between a resting position 50*a* and a dispensing position 50*b* by a cam 26, there are a variety of methods by which the storage container 12 may be moved in relation to a shutter 22.

Figure 30:
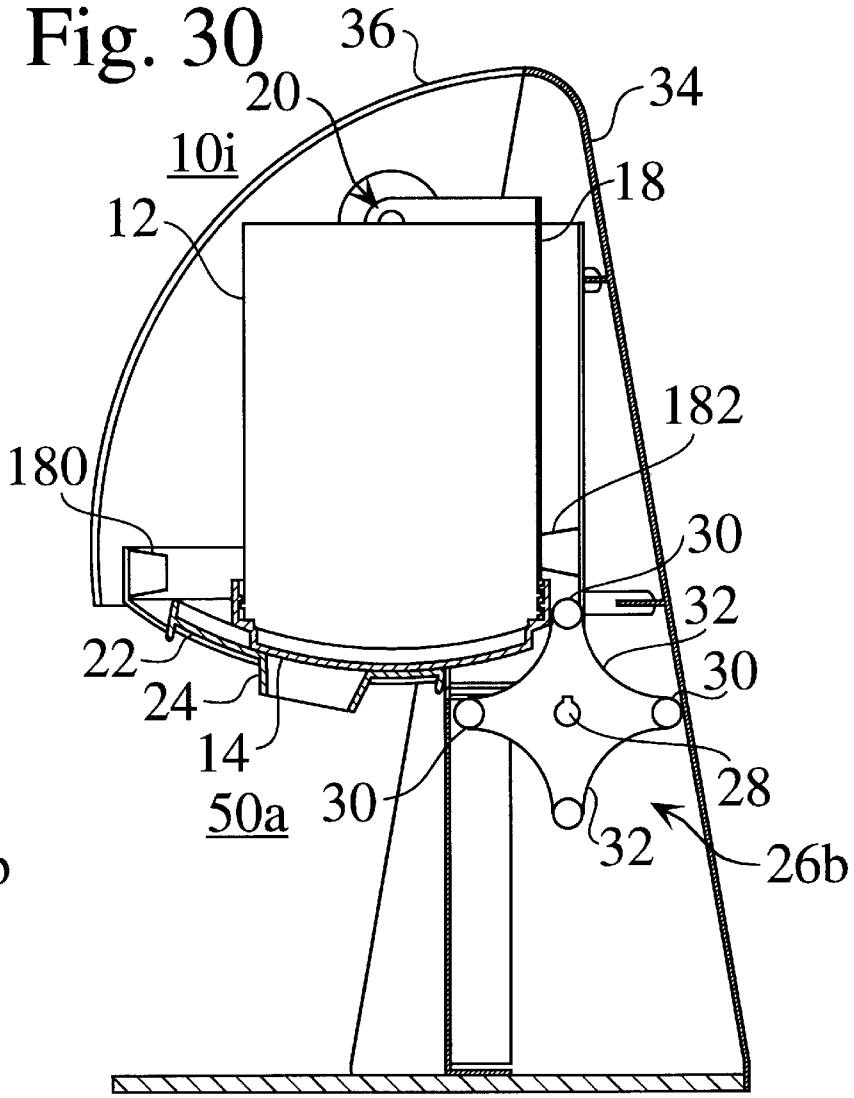
FIG. 30 is a partial cutaway view of an alternate condiment dispensing system in a first resting position against a first travel stop.
Figure 29:
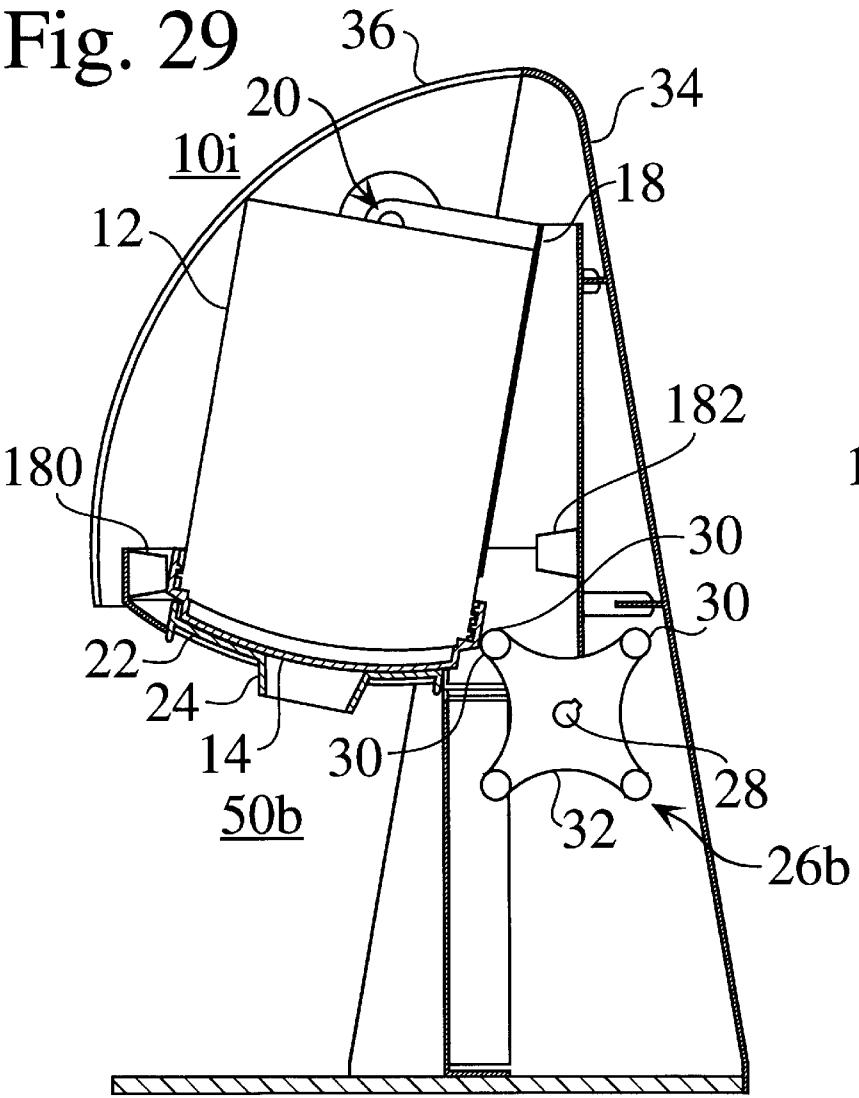
FIG. 29 is a partial cutaway view of an alternate condiment dispensing system in a second dispensing position against a second travel stop.

While the storage container 12 is generally limited to move between resting position 50*a* and a dispensing position 50*b* by direct interaction with the cam 26, the limits of travel for the storage container 12 may be constrained by other components, such as travel stops 180,182. FIG. 29 is a partial cutaway view of an alternate condiment dispensing system 10*i* in a second dispensing position 50*b* against a dispensing travel stop 180. FIG. 30 is a partial cutaway view of the alternate condiment dispensing system 10*i* in a first resting position 50*a* against a rest travel stop 182.

System Advantages. The condiment dispensing system 10 provides many advantages over prior condiment dispensers. The use of one or more condiment dispensing systems 10 allows the customized dispensing of one or more condiments, without requiring the user to manually pick up and dispense the condiment storage containers. As well, the user does not have to manually move or open a dispensing spout, and prevents contact with food-based condiments SC.

Furthermore, the condiment dispensing system 10 can be easily modified to dispense different condiments SC, by simply replacing the storage container 12, lid 14, or shutter 22. The use of different cams 26 and actuators 132 can provide continuous or shaking dispensing motions of the condiment dispensing system 10, allowing different dispersal patterns for the dispensed condiments DC.

Although the condiment dispensing system and its methods of use are described herein in connection with dry condiment dispensing systems, the techniques can be implemented for other dispensing devices or systems, or any combination thereof, as desired.

Accordingly, although the invention has been described in detail with reference to a particular preferred embodiment, persons possessing ordinary skill in the art to which this invention pertains will appreciate that various modifications and enhancements may be made without departing from the spirit and scope of the claims that follow.

What is claimed is:

1. A condiment dispensing system, comprising:

a stationary shutter having a spout; and a storage container having an exterior, an inner volume and a removable lid having a dispensing hole between said inner volume and said exterior, wherein said condiment storage container is movable in relation to said shutter between a first resting position in which said dispensing hole is not in alignment with said spout, and a second dispensing position in which said dispensing hole is in alignment with said spout.

2. The condiment dispensing system of claim 1, wherein said storage container is movable between said first resting position and said second dispensing position along a storage container axis.

3. The condiment dispensing system of claim 1, further comprising:

a rotatable cam, having a ramp and a lobe, in contact with said storage container, wherein when said ramp is in contact with said storage container, said storage container is moved to said first resting position, and when said lobe is in contact with said storage container, said storage container is moved to said second dispensing position.

4. The condiment dispensing system of claim 3, further comprising:

means for rotating said rotatable cam.

5. The condiment dispensing system of claim 1, further comprising:

a rotatable cam, having a lobe and a ramp, in contact with said storage container, wherein when said lobe is in contact with said storage container, said storage container is moved to said first resting position, and when said ramp is in contact with said storage container, said storage container is moved to said second dispensing position.

6. The condiment dispensing system of claim 5, further comprising:

means for rotating said rotatable cam.

7. The condiment dispensing system of claim 1, further comprising:

a stationary housing connected to said stationary shutter.

8. The condiment dispensing system of claim 7, further comprising:

a bias spring connected between said storage container and said stationary housing, whereby when said storage container is moved away from said first resting position, said bias spring applies a force to said storage container in direction of said first resting position.

9. The condiment dispensing system of claim 7, wherein said stationary housing includes means for mounting said condiment dispensing system to a vertical surface.

10. The condiment dispensing system of claim 7, wherein said stationary housing includes means for mounting said condiment dispensing system to a horizontal surface.

11. A condiment dispensing system, comprising:

a stationary shutter having a spout;

a storage container having an exterior, an inner volume and a dispensing hole between said inner volume and said exterior, wherein said condiment storage container is movable in relation to said shutter between a first resting position in which said dispensing hole is not in alignment with said spout, and a second dispensing position in which said dispensing hole is in alignment with said spout; and a rotatable cam, having a ramp and a lobe, in contact with said storage container, wherein when said ramp is in contact with said storage container, said storage container is moved to said first resting position, and when said lobe is in contact with said storage container, said storage container is moved to said second dispensing position.

12. The condiment dispensing system of claim 11, wherein said storage container is movable between said first resting position and said second dispensing position along a storage container axis.

13. The condiment dispensing system of claim 11, further comprising:

means for rotating said rotatable cam.

14. The condiment dispensing system of claim 11, further comprising:

a stationary housing connected to said stationary shutter.

15. The condiment dispensing system of claim 14, further comprising:

a bias spring connected between said storage container and said stationary housing, whereby when said storage container is moved away from said first resting position, said bias spring applies a force to said storage container in direction of said first resting position.

16. The condiment dispensing system of claim 14, wherein said stationary housing includes means for mounting said condiment dispensing system to a vertical surface.

17. The condiment dispensing system of claim 14, wherein said stationary housing includes means for mounting said condiment dispensing system to a horizontal surface.

18. A condiment dispensing system, comprising:

a stationary shutter having a spout; and a storage container having an exterior, an inner volume and a dispensing hole between said inner volume and said exterior, wherein said condiment storage container is movable in relation to said shutter between a first resting position in which said dispensing hole is not in alignment with said spout, and a second dispensing position in which said dispensing hole is in alignment with said spout; and a rotatable cam, having a lobe and a ramp, in contact with said storage container, wherein when said lobe is in contact with said storage container, said storage container is moved to said first resting position, and when said ramp is in contact with said storage container, said storage container is moved to said second dispensing position.

19. The condiment dispensing system of claim 18, wherein said storage container is movable between said first resting position and said second dispensing position along a storage container axis.

20. The condiment dispensing system of claim 18, further comprising:

means for rotating said rotatable cam.

21. The condiment dispensing system of claim 18, further comprising:

a stationary housing connected to said stationary shutter.

22. The condiment dispensing system of claim 21, further comprising:

a bias spring connected between said storage container and said stationary housing, whereby when said storage container is moved away from said first resting position, said bias spring applies a force to said storage container in direction of said first resting position.

23. The condiment dispensing system of claim 21, wherein said stationary housing includes means for mounting said condiment dispensing system to a vertical surface.

24. The condiment dispensing system of claim 21, wherein said stationary housing includes means for mounting said condiment dispensing system to a horizontal surface.

25. A dispensing system, comprising:

a base;

a stationary shutter having a spout connected to said base; and a storage container located over said stationary shutter, said storage container having a lower surface, an inner volume, and a removable lid having a dispensing hole between said inner volume and said lower surface, wherein said storage container is movable in relation to said shutter between a first resting position in which said dispensing hole is not in alignment with said spout, and a second dispensing position in which said dispensing hole is in alignment with said spout.

26. The dispensing system of claim 25, wherein said storage container is movable between said first resting position and said second dispensing position along a storage container axis.

27. The dispensing system of claim 25, further comprising:

a rotatable cam mounted to said base, said rotatable cam having a ramp and a lobe in contact with said storage container, wherein when said ramp is in contact with said storage container, said storage container is moved to said first resting position, and when said lobe is in contact with said storage container, said storage container is moved to said second dispensing position.

28. The dispensing system of claim 27, further comprising:

means for rotating said rotatable cam.

29. The dispensing system of claim 25, further comprising:

a rotatable cam having a lobe and a ramp mounted to said base, said rotatable cam in contact with said storage container, wherein when said lobe is in contact with said storage container, said storage container is moved to said first resting position, and when said ramp is in contact with said storage container, said storage container is moved to said second dispensing position.

30. The dispensing system of claim 29, further comprising:

means for rotating said rotatable cam.

31. The dispensing system of claim 25, further comprising:

a bias spring connected between said storage container and said base, whereby when said storage container is moved away from said first resting position, said bias spring applies a force to said storage container in direction of said first resting position.

32. The dispensing system of claim 25, wherein said base includes means for mounting said dispensing system to a vertical surface.

33. The dispensing system of claim 25, wherein said base includes means for mounting said dispensing system to a horizontal surface.

34. A dispensing system, comprising:

a base;

a stationary shutter having a spout connected to said base;

a storage container located over said stationary shutter, said storage container having a lower surface, an inner volume and a dispensing hole between said inner volume and said lower surface, wherein said storage container is movable in relation to said shutter between a first resting position in which said dispensing hole is not in alignment with said spout, and a second dispensing position in which said dispensing hole is in alignment with said spout; and a rotatable cam mounted to said base, said rotatable cam having a ramp and a lobe in contact with said storage container, wherein when said ramp is in contact with said storage container, said storage container is moved to said first resting position, and when said lobe is in contact with said storage container, said storage container is moved to said second dispensing position.

35. The dispensing system of claim 34, wherein said storage container is movable between said first resting position and said second dispensing position along a storage container axis.

36. The dispensing system of claim 34, further comprising:

means for rotating said rotatable cam.

37. The dispensing system of claim 34, further comprising:

a bias spring connected between said storage container and said base, whereby when said storage container is moved away from said first resting position, said bias spring applies a force to said storage container in direction of said first resting position.

38. The dispensing system of claim 34, wherein said base includes means for mounting said dispensing system to a vertical surface.

39. The dispensing system of claim 34, wherein said base includes means for mounting said dispensing system to a horizontal surface.

40. A dispensing system, comprising:

a base;

a stationary shutter having a spout connected to said base;

a storage container located over said stationary shutter, said storage container having a lower surface, an inner volume and a dispensing hole between said inner volume and said lower surface, wherein said storage container is movable in relation to said shutter between a first resting position in which said dispensing hole is not in alignment with said spout, and a second dispensing position in which said dispensing hole is in alignment with said spout; and a rotatable cam having a lobe and a ramp mounted to said base, said rotatable cam in contact with said storage container, wherein when said lobe is in contact with said storage container, said storage container is moved to said first resting position, and when said ramp is in contact with said storage container, said storage container is moved to said second dispensing position.

41. The dispensing system of claim 40, wherein said storage container is movable between said first resting position and said second dispensing position along a storage container axis.

42. The dispensing system of claim 40, further comprising:

means for rotating said rotatable cam.

43. The dispensing system of claim 40, further comprising:

a bias spring connected between said storage container and said base, whereby when said storage container is moved away from said first resting position, said bias spring applies a force to said storage container in direction of said first resting position.

44. The dispensing system of claim 40, wherein said base includes means for mounting said dispensing system to a vertical surface.

45. The dispensing system of claim 40, wherein said base includes means for mounting said dispensing system to a horizontal surface.

46. A process, comprising the steps of:

providing a base;

locating a stationary shutter having a spout over said base;

locating a storage container over said stationary shutter, said storage container having a lower surface, an inner volume, and a removable lid having a dispensing hole between said inner volume and said lower surface; and moving said storage container in relation to said shutter between a first resting position in which said dispensing hole is not in alignment with said spout, and a second dispensing position in which said dispensing hole is in alignment with said spout.

47. The process of claim 46, wherein said storage container is movable between said first resting position and said second dispensing position along a storage container axis.

48. The process of claim 46, further comprising the step of:

mounting a rotatable cam to said base, said rotatable cam having a ramp and a lobe, wherein when said ramp is in contact with said storage container, said storage container is moved to said first resting position, and when said lobe is in contact with said storage container, said storage container is moved to said second dispensing position.

49. The process of claim 48, further comprising the step of:

providing a means for rotating said rotatable cam.

50. The process of claim 46, further comprising the step of:

mounting a rotatable cam to said base, said rotatable cam having a lobe and a ramp, wherein when said lobe is in contact with said storage container, said storage container is moved to said first resting position, and when said ramp is in contact with said storage container, said storage container is moved to said second dispensing position.

51. The process of claim 50, further comprising the step of:

providing a means for rotating said rotatable cam.

52. The process of claim 46, further comprising the step of:

connecting a bias spring between said storage container and said base, whereby when said storage container is moved away from said first resting position, said bias spring applies a force to said storage container in direction of said first resting position.

53. The process of claim 46, wherein said base includes means for mounting said dispensing system to a vertical surface.

54. The process of claim 46, wherein said base includes means for mounting said dispensing system to a horizontal surface.

55. A process, comprising the steps of:

providing a base;

locating a stationary shutter having a spout over said base;

locating a storage container over said stationary shutter, said storage container having a lower surface, an inner volume and a dispensing hole between said inner volume and said lower surface;

moving said storage container in relation to said shutter between a first resting position in which said dispensing hole is not in alignment with said spout, and a second dispensing position in which said dispensing hole is in alignment with said spout; and mounting a rotatable cam to said base, said rotatable cam having a ramp and a lobe, wherein when said ramp is in contact with said storage container, said storage container is moved to said first resting position, and when said lobe is in contact with said storage container, said storage container is moved to said second dispensing position.

56. The process of claim 55, wherein said storage container is movable between said first resting position and said second dispensing position along a storage container axis.

57. The process of claim 55, further comprising the step of:

providing a means for rotating said rotatable cam.

58. The process of claim 55, further comprising the step of:

connecting a bias spring between said storage container and said base, whereby when said storage container is moved away from said first resting position, said bias spring applies a force to said storage container in direction of said first resting position.

59. The process of claim 55, wherein said base includes means for mounting said dispensing system to a vertical surface.

60. The process of claim 55, wherein said base includes means for mounting said dispensing system to a horizontal surface.

61. A process, comprising the steps of:

providing a base;

locating a stationary shutter having a spout over said base;

locating a storage container over said stationary shutter, said storage container having a lower surface, an inner volume and a dispensing hole between said inner volume and said lower surface;

moving said storage container in relation to said shutter between a first resting position, in which said dispensing hole is not in alignment with said spout, and a second dispensing position in which said dispensing hole is in alignment with said spout; and mounting a rotatable cam to said base, said rotatable cam having a lobe and a ramp, wherein when said lobe is in contact with said storage container, said storage container is moved to said first resting position, and when said ramp is in contact with said storage container, said storage container is moved to said second dispensing position.

62. The process of claim 61, wherein said storage container is movable between said first resting position and said second dispensing position along a storage container axis.

63. The process of claim 61, further comprising the step of:

providing a means for rotating said rotatable cam.

64. The process of claim 61, further comprising the step of:

connecting a bias spring between said storage container and said base, whereby when said storage container is moved away from said first resting position, said bias spring applies a force to said storage container in direction of said first resting position.

65. The process of claim 61, wherein said base includes means for mounting said dispensing system to a vertical surface.

66. The process of claim 61, wherein said base includes means for mounting said dispensing system to a horizontal surface.

* * * * *